US012252984B2

(12) United States Patent
Miller et al.

(10) Patent No.: US 12,252,984 B2
(45) Date of Patent: Mar. 18, 2025

(54) INTRA-BOTTOM HOLE ASSEMBLY (BHA) WIRELESS COMMUNICATION SYSTEM

(71) Applicant: ERDOS MILLER, INC., Houston, TX (US)

(72) Inventors: Kenneth Miller, Houston, TX (US); David Erdos, Houston, TX (US); Abraham Erdos, Houston, TX (US)

(73) Assignee: ERDOS MILLER, INC., Houston, TX (US)

( * ) Notice: Subject to any disclaimer, the term of this patent is extended or adjusted under 35 U.S.C. 154(b) by 0 days.

(21) Appl. No.: 18/029,784

(22) PCT Filed: Oct. 1, 2021

(86) PCT No.: PCT/US2021/053222
§ 371 (c)(1),
(2) Date: Mar. 31, 2023

(87) PCT Pub. No.: WO2022/072866
PCT Pub. Date: Apr. 7, 2022

(65) Prior Publication Data

US 2023/0407740 A1 Dec. 21, 2023

Related U.S. Application Data

(60) Provisional application No. 63/087,117, filed on Oct. 2, 2020.

(51) Int. Cl.
*E21B 47/13* (2012.01)
*E21B 47/14* (2006.01)

(52) U.S. Cl.
CPC ..... *E21B 47/13* (2020.05); *E21B 47/14* (2013.01)

(58) Field of Classification Search
CPC ..... E21B 47/12; E21B 47/13; E21B 47/14; E21B 47/18
See application file for complete search history.

(56) References Cited

U.S. PATENT DOCUMENTS 5,160,925 A * 11/1992 Dailey ..... E21B 47/13 340/854.6
5,448,227 A 9/1995 Orban et al.
(Continued)

OTHER PUBLICATIONS

Notification Concerning Transmittal of International Preliminary Report on Patentability (Chapter I of the Patent Cooperation Treaty) dated Apr. 13, 2023 (Apr. 13, 2023) on related international patent application PCT/US2021/053222 by The International Bureau of WIPO.

*Primary Examiner* — Kenneth L Thompson
(74) *Attorney, Agent, or Firm* — Dickinson Wright PLLC

(57) ABSTRACT

A method is disclosed for receiving, from a downhole system, data at a transmitter module of an intra-bottom hole assembly (BHA), wherein the transmitter module comprises a magnetic transmission antenna; transmitting, via a wireless short-range communication using the magnetic transmission antenna, the data to a receiver module of the intra-BHA, wherein the transmitter module and the receiver module form an intra-BHA network using the wireless short-range communication; receiving, via the wireless short-range communication, the data at the receiver module; transmitting the data to a measurement while drilling (MWD) tool; receiving, at the MWD tool, the data; and transmitting, via a type of telemetry, the data from the MWD tool to a surface processor.

20 Claims, 17 Drawing Sheets

(56) References Cited

U.S. PATENT DOCUMENTS

| | | | | |
|---|---|---|---|---|
| 7,518,528 | B2 * | 4/2009 | Price | E21B 17/028 340/854.6 |
| 8,115,651 | B2 * | 2/2012 | Camwell | H04W 40/10 340/853.2 |
| 10,018,747 | B2 * | 7/2018 | Rozenblit | E21B 47/13 |
| 10,119,393 | B2 * | 11/2018 | Derkacz | E21B 47/13 |
| 10,301,931 | B2 * | 5/2019 | Derkacz | E21B 47/13 |
| 10,975,689 | B1 * | 4/2021 | Sun | E21B 47/013 |
| 2003/0010492 | A1 | 1/2003 | Hill et al. | |
| 2005/0279532 | A1 | 12/2005 | Ballantyne et al. | |
| 2009/0160444 | A1 | 6/2009 | Chwala et al. | |
| 2009/0322640 | A1 | 12/2009 | LeVan | |
| 2012/0091959 | A1 | 4/2012 | Martin et al. | |
| 2016/0291193 | A1 | 10/2016 | Williams | |
| 2021/0148222 | A1 * | 5/2021 | Dwyer | H04B 1/1027 |

* cited by examiner

INTRA-BOTTOM HOLE ASSEMBLY (BHA) WIRELESS COMMUNICATION SYSTEM

CROSS REFERENCE TO RELATED APPLICATIONS

This application is a U.S. National Phase patent application of and claims priority to PCT/US2021/053222, filed Oct. 1, 2021, which claims priority to U.S. Prov. Application No. 63/087,117, filed Oct. 2, 2020, titled "Intra-Bottom Hole Assembly (BHA) Wireless Communication System," which are hereby incorporated by reference in its entirety for all purposes.

TECHNICAL FIELD

This disclosure relates generally to wireless communication and, in particular, to an intra-bottom hole assembly (BHA) wireless communication system.

BACKGROUND

One problem encountered in well borehole is enabling components that are disposed within the well, and that do not have a means for long range communication of data, to be able to transmit and receive data with a measurement while drilling tool and/or a surface system.

SUMMARY

In one embodiment, a method is disclosed. The method includes receiving, from a downhole system, data at a transmitter module of an intra-bottom hole assembly (BHA), wherein the transmitter module comprises a magnetic transmission antenna; transmitting, via a wireless short-range communication using the magnetic transmission antenna, the data to a receiver module of the intra-BHA, wherein the transmitter module and the receiver module form an intra-BHA network using the wireless short-range communication; receiving, via the wireless short-range communication, the data at the receiver module; transmitting the data to a measurement while drilling (MWD) tool; receiving, at the MWD tool, the data; and transmitting, via a type of telemetry, the data from the MWD tool to a surface processor.

In one embodiment, a tangible, non-transitory computer-readable medium may store instructions that, when executed, cause a processing device to perform any of the methods, operations, and/or functions described herein.

In one embodiment, a system may include a memory device storing instructions, and a processing device communicatively coupled to the memory device. The processing device may execute the instructions to perform any of the methods, operations, and/or functions described herein.

In one embodiments, an intra-BHA may be disclosed and may include a transmitter module and a receiver module that form an intra-BHA communication network. The transmitter module may include a magnetic transmission antenna and the receiver module may include one or more magnetometers.

Other technical features may be readily apparent to one skilled in the art from the following figures, descriptions, and claims. These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the present disclosure. As used in the specification and in the claims, the singular form of 'a', 'an', and 'the' include plural referents unless the context clearly dictates otherwise.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), solid state drives (SSDs), flash, or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

Figure 1:
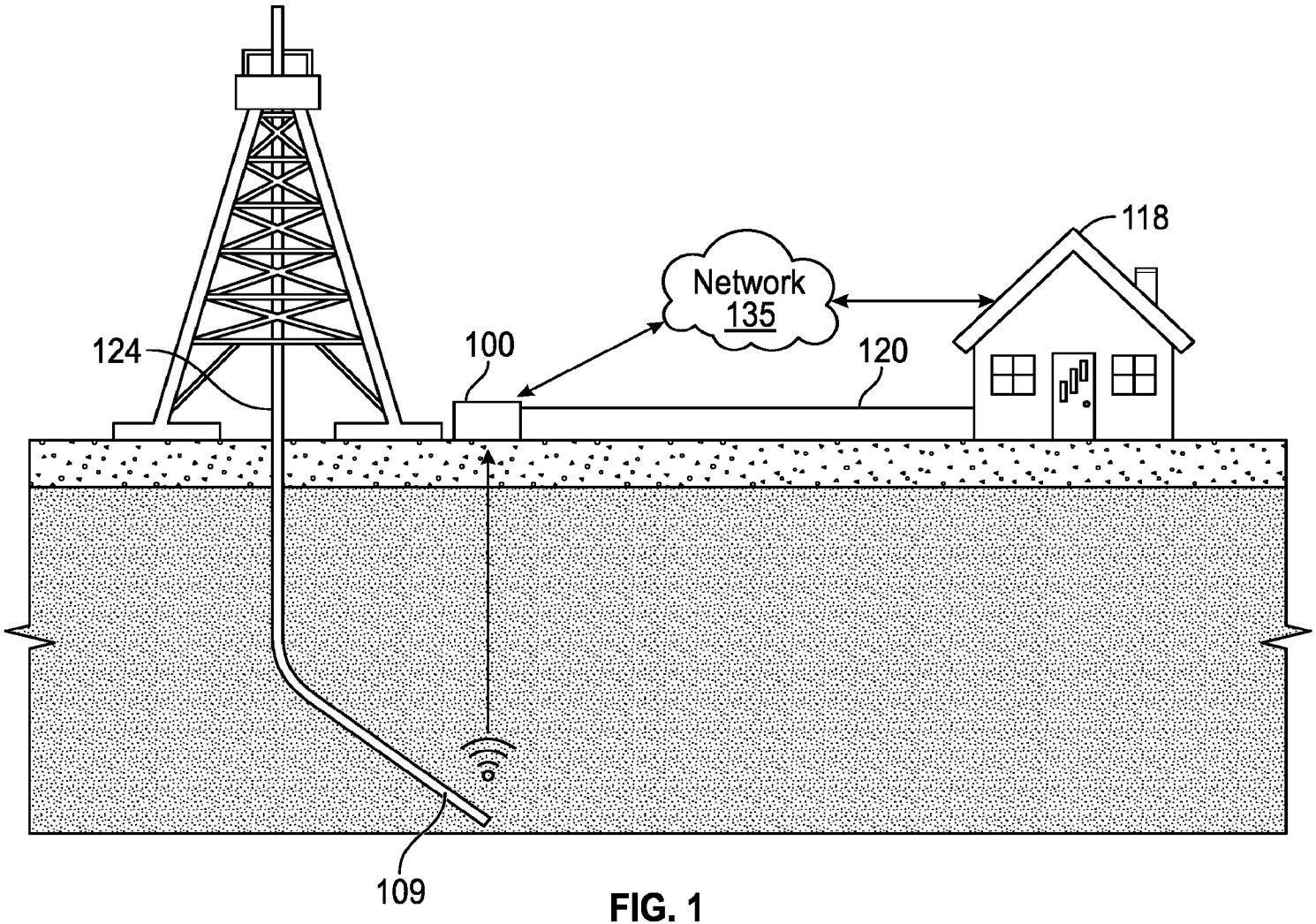
FIG. 1 depicts the MWD data acquisition system as placed next to an oil rig, according to embodiments of the disclosure.

FIGS. 1 through 20, discussed below, and the various embodiments used to describe the principles of this disclosure are by way of illustration only and should not be construed in any way to limit the scope of the disclosure.

Techniques for an intra-bottom hole assembly (BHA) wireless communication system is disclosed. A bottom hole assembly (BHA) is a component of a drilling rig. It is the lowest part of the drill string, extending from the bit to the drill pipe. The assembly can consist of drill collars, subs such as stabilizers, reamers, shocks, hole-openers, and the bit sub and bit. Certain components (e.g., rotary steerable systems) located in proximity to an intra-BHA and/or a measurement while drilling (MWD) tool (e.g., retrievable via a spearpoint or may be non-retrievable) may be incapable of transmitting data over a long range. The components may acquire and/or generate data and may be configured and capable of transmitting the data using short range communication techniques.

An intra-BHA network may be utilized. The intra-BHA network may include a magnetic system, an acoustic system, and/or an electromagnetic system. In one embodiment, a magnetic transmitter antenna (e.g., one or more coil windings wrapped around one or more ferrous cores) may be used in a transmitter of the intra-BHA to transmit a signal including data received from a downhole system (e.g., rotary steerable system, drill bit, mud motor, etc.), and a receiver may include one or more magnetometers configured to receive the signal from the magnetic transmitter antenna. Magnetometers may measure magnetic field or magnetic dipole moments. In some embodiments, the magnetometers may be configured to measure the direction, strength, and/or relative change of a magnetic field at a particular location. Accelerometers and magnetometers may be used to measure inclination and direction (azimuth). The magnetometers may measure magnetic influences within casing where the hole is lined with tubes and/or pipes of the drill string. The data included in a received signal and/or magnetic field by the magnetometers may be digitally converted into units, values, measurements, digits, etc. For example, the data may be converted by a surface processor or by a downhole processor in a MWD tool.

In one embodiment, an acoustic system may be used in a transmitter of the intra-bottom hole assembly to perform wireless communication over a short range. For example, the transmitter may include a piezoelectric stack and may use electric material to create acoustic sound waves (e.g., data pattern) or vibrations in a collar or wall of the drill pipe and those acoustic sound waves may travel to an accelerometer. The accelerometer may measure and process an impact frequency of the acoustic sound waves or vibrations as they are received and/or may transmit a signal representing the vibrations or vibrations to a receiver. As described below, telemetry (e.g., mud pulse and/or electromagnetic telemetry) may be used to transmit the data received from the magnetic transmission antenna to the surface processor.

The receiver may transmit the signal to the MWD tool via various communication interfaces, such as CAN, UART, RS-485, qMIX, etc. The MWD tool may use telemetry (e.g., mud pulse and/or electromagnetic) to transmit a pressure signal to a surface processor for processing, analysis, recording, storage, modification, etc. Such an acoustic system enables establishing wireless communication between the intra-bottom hole assembly, MWD tool, and the surface processor. Mud pulse telemetry may refer to a system of using valves to modulate the flow of drilling fluid in a bore of the drillstring. The valve restriction can generate a pressure pulse that propagate up the column of fluid inside the drillstring and then be detected by pressure transducers at the surface processor. The EM mode enables data transmission without a continuous fluid column, providing an alternative to negative and positive pulse systems. An EM telemetry system may refer to a system that applies a differential voltage, positive and negative voltage, across an insulative gap in the drill string. The differential voltage causes current to flow through the formation creating equipotential lines that can be detected by sensors at the surface. Due to the formation dependence, EM communication can be hindered by particularly high and low conductivity environments.

Another system that may be employed by the intra-bottom hole assembly (BHA) may include an electromagnetic system. Such a system may include a coil that discharges or charges an electromagnetic field in a data pattern and an electromagnetic sensing element (e.g., magnetometer, solenoid, etc.) may receive the electromagnetic field and transmit a signal to a receiver. The receiver may transmit the signal to the MWD tool via various communication interfaces, such as CAN, UART, RS-485, qMIX, etc. The MWD tool may use telemetry (e.g., mud pulse and/or electromagnetic) to transmit a pressure signal to a surface processor for processing, analysis, recording, storage, modification, etc. Such an electromagnetic system enables establishing wireless communication between the intra-bottom hole assembly, MWD tool, and the surface processor.

There are various applications that may be enabled using the disclosed techniques. A first application is for new/semi-new class of devices referred to as rotary steerable systems (RSS). The rotary steerable system may be connected into the network via the transmitter of the intra-BHA so it is enabled (via the acoustic system, magnetic system, or the electromagnetic system) to communicate its status and/or any suitable data to the MWD tool, via short range communications, and the MWD tool may transmit its status and/or any suitable data to the surface processor. The communication schemes via mud pulse and electromagnetic are two-way communications. Thus, a command entered via the surface processor may be relayed down to the MWD tool, which relays the command on the intra-BHA network to the rotary steerable system. The command may cause the rotary steerable system to change an operating parameter (e.g., steering direction).

Another application may pertain to a remote sensing sub. A sub may include a gamma sensor or azimuth gamma sensor or pressure while drilling strain gauge sensor or an inclination sensor. That sub may be placed below the MWD tool with its own power source, and placed lower than the intra-BHA, which may allow obtaining information closer to the bit and short hop the information using the intra-BHA network (e.g., magnetic system, acoustic system, and/or electromagnetic system) to the MWD tool. That information may be transmitted to the surface processor.

Another application may include control of a smart agitator or a smart reamer. An agitator (friction reduction tool) may receive a command from the surface using the MWD tool and the intra-BHA network to turn the agitator on or off, or to change a setting. For a smart reamer, its blades may be deployable, and the blades may be controlled from the surface sending commands to the MWD tool and using the intra-BHA tool to transmit the command to the smart reamer to deploy one or more blades.

Another application may include the MWD tool making smart downhole decisions on its own about the drilling parameters based on information it receives from the RSS, the agitator, the reamer, the remote sensing sub, or any other suitable downhole component. The MWD tool may instruct those components to change an operating parameter, setting, or the like. For example, the RSS may be getting stuck, so the MWD tool may cause a setting on the agitator to change. Those commands may be relayed across the intra-BHA network.

FIG. 1 shows the MWD data acquisition system 100 as placed next to an oil rig. The MWD data acquisition system 100 includes at least one data reception device. In some embodiments, there may be more than one data reception device. The data reception device may include various components, such as a pressure transducer configured to receive a pressure signal from the MWD tool 109, an analog data reception circuit configured to receive analog MWD data from the pressure transducer and/or MWD tool 109, an analog-to-digital conversion circuit configured to convert the analog MWD data to digital MWD data, a data transmission circuit configured to transmit analog and/or digital data to a surface computing device 118.

In some embodiments, the surface computing device 118 may be local or remote from the MWD data acquisition system 100. For example, the MWD data acquisition system 100 may be locally communicatively connected, via a cable 120, to the surface computing device 118 or the MWD data acquisition system 100 may be remotely communicatively coupled, via a network 135, to the surface computing device 118. In some embodiments, the MWD data acquisition system 100 may be included as a component of the surface computing device 118. In some embodiments, the MWD data acquisition system 100 may include or be coupled to a component (e.g., pressure transducer) configured to receive the data sent from the MWD tool 109. In some embodiments, the MWD data acquisition system 100 is configured to transmit digital data to a surface computing device 118 via a network 135 and/or the cable 120 using, for example, one of the following cable and communication standards: RS-232, RS-422, RS-485, Ethernet, USB, or CAN bus. Network 135 may be a public network (e.g., connected to the Internet via wired (Ethernet) or wireless (WiFi)), a private network (e.g., a local area network (LAN) or wide area network (WAN)), or a combination thereof. Network 135 may also comprise a node or nodes on the Internet of Things (IoT).

The MWD tool 109 may be programmed with information such as which measurements to take and which data to transmit back to the surface. The MWD tool 109 may include a downhole processor. Communicating data between the downhole processor and a surface processor (e.g., included in the surface computing device 118) may be performed using various types of telemetry. For example, mud pulse (MP) telemetry and/or electromagnetic (EM) telemetry.

The surface computing device 118 may be any suitable computing device, such as a laptop, tablet, smartphone, or computer. The surface computing device 118 may include a display capable of presenting a user interface of an application. The application may be implemented in computer instructions stored on the one or more memory devices of the surface computing device 118 and executable by the one or more processing devices of the surface computing device 118.

Figure 2:
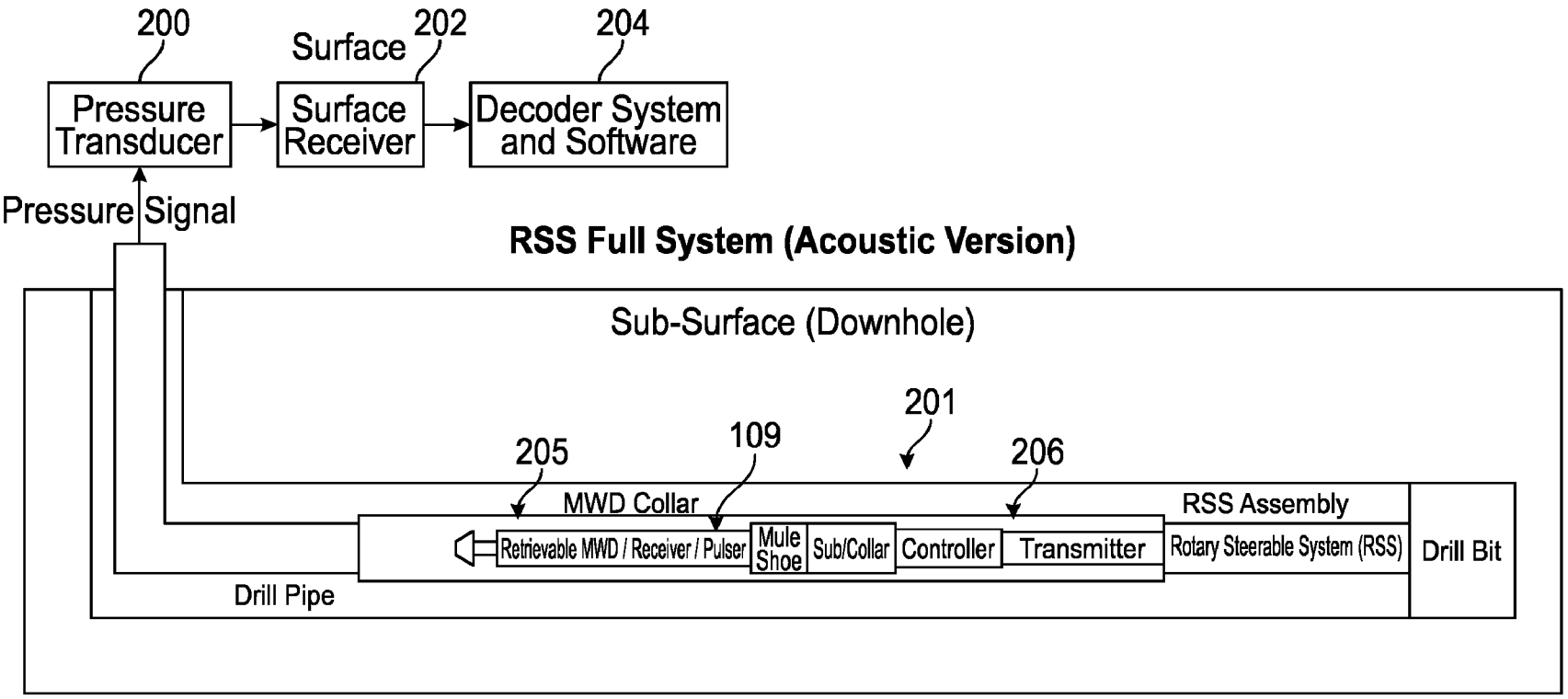
FIG. 2 is a block diagram of a drill pipe including a MWD tool, an intra-BHA (acoustic version), a RSS, and a drill bit.

FIG. 2 is a block diagram of a drill pipe including a MWD tool 109, an intra-BHA 201, a RSS, and a drill bit. The drill pipe including the MWD tool 109, intra-BHA, RSS, and drill bit are included sub-surface (downhole), and a pressure transducer 200, a surface processor 202, and a decoder system and software 204 are included at the surface (e.g., at or near a rig). As depicted, a MWD collar 205 includes a retrievable (or non-retrievable) MWD tool, receiver assembly, a pulser, and a mule shoe. The MWD collar is connected to a transmitter collar 206 via a sub/collar. The transmitter collar includes a transmitter assembly or transmitter module and a centralizer. The transmitter collar is connected to the RSS or any other suitable downhole system, which is further connected to a drill bit. The intra-BHA may include one or more components of the MWD collar, sub/collar, and/or the transmitter collar. For example, the intra-BHA may include at least the receiver assembly and the transmitter assembly.

In general, the RSS may send information to the transmitter assembly via a short range wireless or wired communication. The intra-BHA may create an intra-BHA network using at least the receiver assembly (also referred to herein as receiver module) and the transmitter assembly (also referred to herein as transmitter module). The intra-BHA network may by formed via a magnetic system, an acoustic system and/or an electromagnetic system as described herein. The data from the RSS may be transmitted using the intra-BHA network to the MWD tool, which may transmit the data using a type of telemetry (mud pulse or electromagnetic) as a pressure signal to a pressure transducer 200 at the surface. The telemetry may enable two-way communication so the surface may transmit commands back to the MWD tool, which may relay the commands via the intra-BHA network to the RSS or any suitable downhole system. The command may control the RSS to change a parameter, an operating setting, and the like. At the surface, the pressure transducer may transmit the signal to the surface processor 202, which may include a surface receiver and/or decoder system and software 204. The decoder system and software 204 may decode the digital data and present the data on a user interface of a computing device.

The transmitter assembly may include piezoelectric stack that causes one or more vibrations to be transmitted across the sub/collar and received by one or more accelerometers. The accelerometers may convert the received vibrations by measuring either static or dynamic acceleration of a structure.

Figure 3:
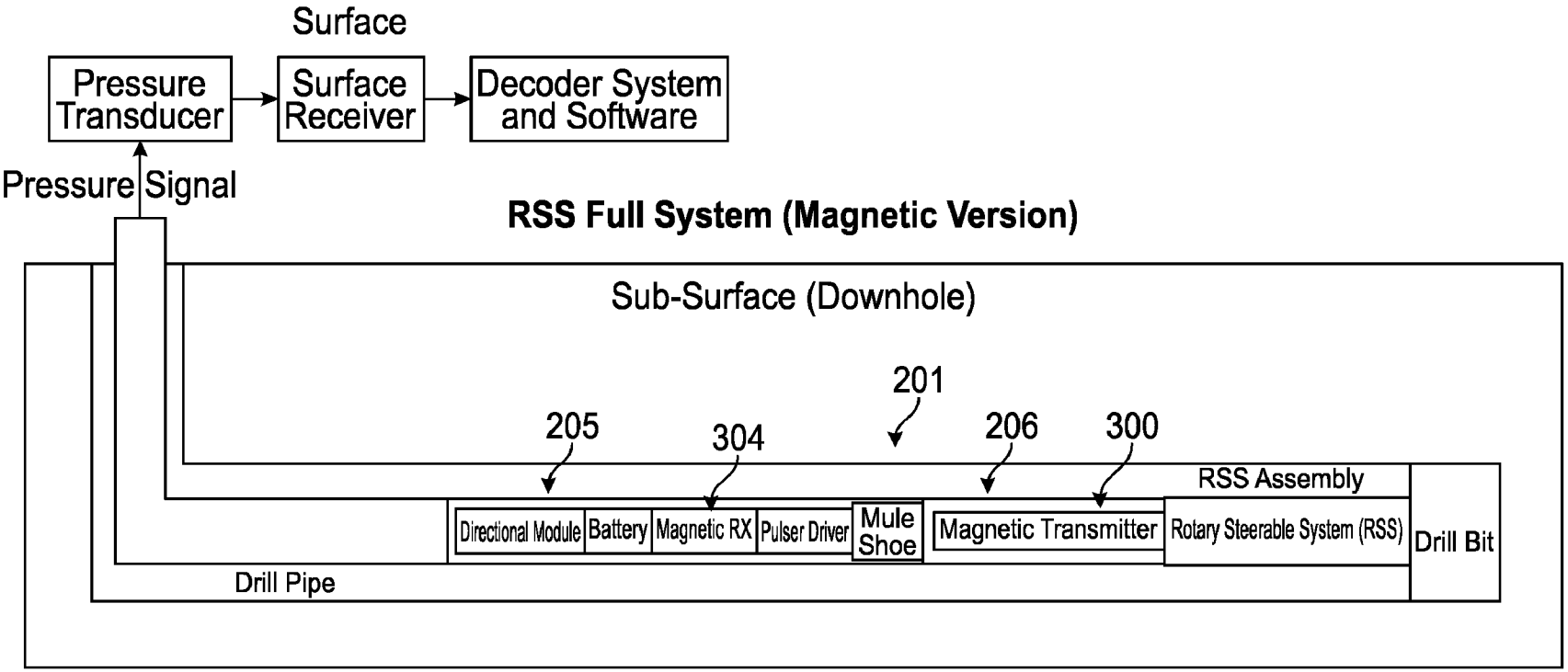
FIG. 3 is a block diagram of a drill pipe including a MWD tool, an intra-BHA (magnetic version), a RSS, and a drill bit.

FIG. 3 is a block diagram of a drill pipe including a MWD tool, an intra-BHA 201 (magnetic version), a RSS, and a drill bit. The components depicted at the surface are the same as those depicted in FIG. 2. As depicted in FIG. 3, a transmitter collar 206 includes a magnetic transmitter 300 (transmitter module) which may include a magnetic transmission antenna, as further described herein. The magnetic transmission antenna may include one or more ferrous cores wrapped by one or more coil windings. The transmitter collar 206 is connected to the RSS or any other suitable downhole system, which is further connected to a drill bit. The MWD collar 205 may include a directional module, a battery, a magnetic receiver 304, a pulser driver, and/or a mule shoe. In some embodiments, the magnetic receiver 304 and/or the directional module in the MWD tool may function as a receiver depending on the available signal strength of the signal transmitted by the magnetic transmitter 300. The magnetic receiver 304 (receiver module) may include one or more magnetometers and/or solenoids configured to detect one or more magnetic fields and/or signals including data transmitted by the magnetic transmitter 300. The directional module may be configured to determine an azimuth, direction, and/or orientation of a toolface of the drill string based on the data received by the magnetic receiver 304.

Figure 4:
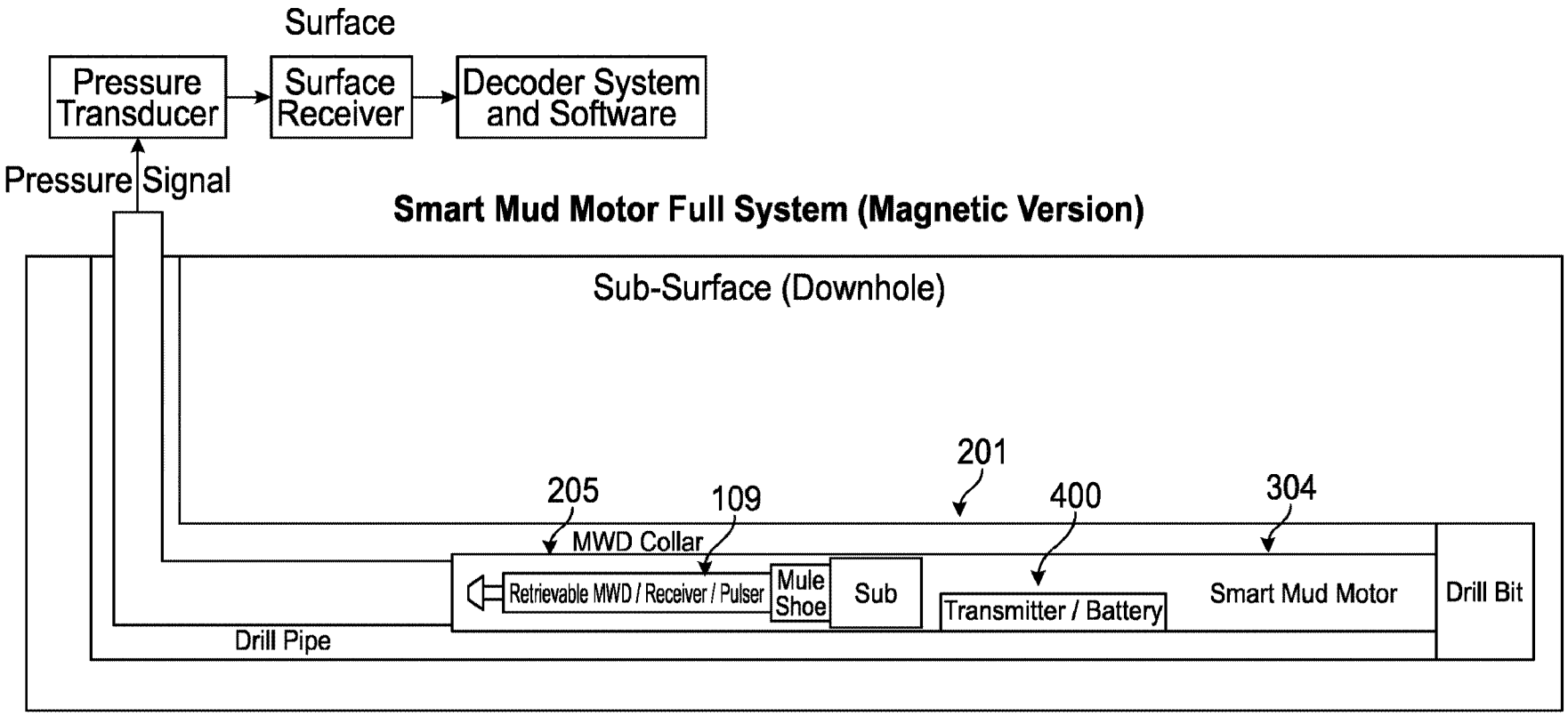
FIG. 4 is a block diagram of a drill pipe including a MWD tool, an intra-BHA (magnetic version), a smart mud motor, and a drill bit.

FIG. 4 is a block diagram of a drill pipe including a MWD tool, an intra-BHA 201 (magnetic version), a smart mud motor, and a drill bit. The components included in FIG. 4 at the surface are the same as those depicted in FIG. 2. Also, the MWD collar 205 in FIG. 4 includes the same components as depicted in FIG. 2. As depicted in FIG. 4, a smart mud motor 304 may be connected between a sub and the drill bit. The smart mud motor 304 may include a transmitter and battery module 400 installed and/or integrated directly as one or more components of the smart mud motor 304. The transmitter and battery module 400 included with the smart mud motor 304 may include a magnetic transmission antenna that transmits a magnetic field and/or signal. The MWD tool 109 may include one or more magnetometers on a control board such that a separate magnetic receiver is not needed to receive the data from the transmitter and battery module 400. In other words, the circuitry and electronics included with the MWD tool 109 may be used to receive data from the magnetic transmission antenna.

Figure 5:
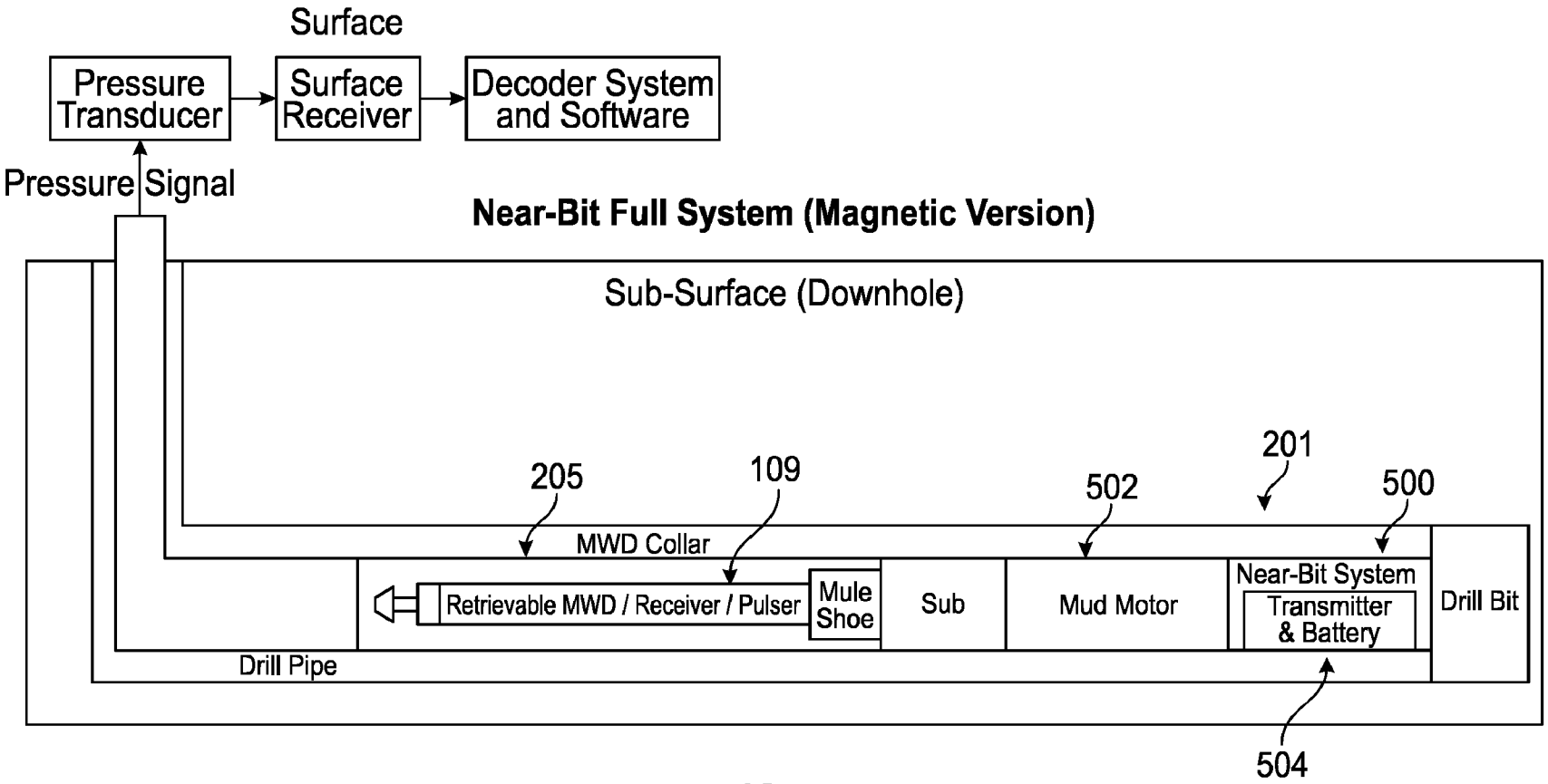
FIG. 5 is a block diagram of a drill pipe including a MWD tool, an intra-BHA, a mud motor, a near-bit system (magnetic version), and a drill bit.

FIG. 5 is a block diagram of a drill pipe including a MWD tool, an intra-BHA 201, a mud motor, a near-bit system (magnetic version) 500, and a drill bit. The components included in FIG. 5 at the surface are the same as those depicted in FIG. 2. Also, the MWD collar 205 in FIG. 5 includes the same components as depicted in FIG. 2. As depicted in FIG. 5, a mud motor 502 is disposed between a sub and the near-bit system 500. The near-bit system 500 may include various electronics such as a transmitter and battery module 504, a processing device, a memory device, and the like. In some embodiments, the transmitter and battery module 504 may be installed and/or integrated directly as components of the near-bit system 500. The transmitter and battery module 504 may include a magnetic transmission antenna that transmits a magnetic field and/or signal. The MWD tool 109 may include one or more magnetometers on a control board such that a separate magnetic receiver is not needed to receive the data from the transmitter and battery module 400. In other words, the circuitry and electronics included with the MWD tool 109 may be used to receive data from the magnetic transmission antenna.

Figure 6:
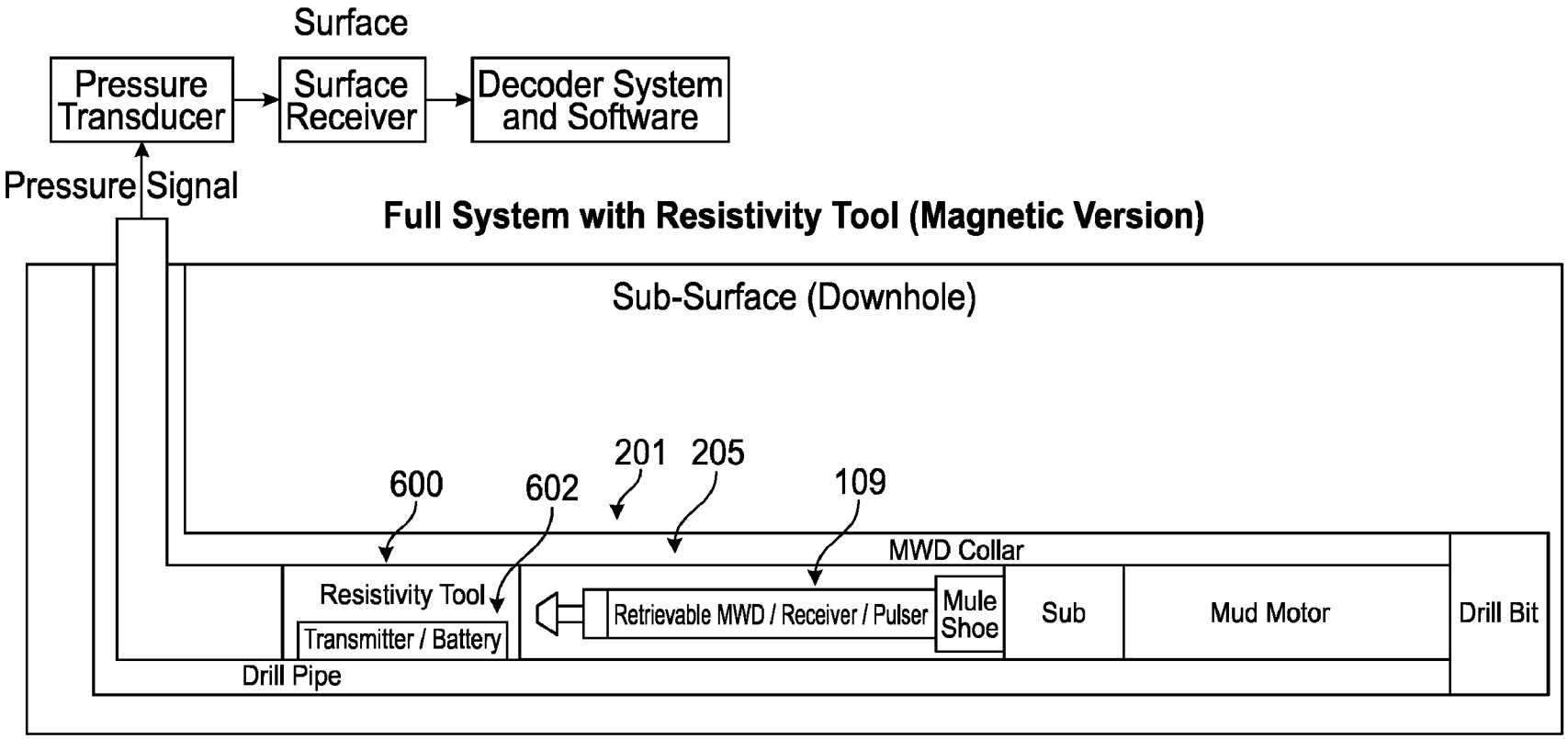
FIG. 6 is a block diagram of a drill pipe including a resistivity tool, a MWD tool, a mud motor, and a drill bit.

FIG. 6 is a block diagram of a drill pipe including a resistivity tool, a MWD tool, an intra-BHA 201, a mud motor, and a drill bit. The components included in FIG. 6 at the surface are the same as those depicted in FIG. 2. Also, the MWD collar 205 in FIG. 6 includes the same components as depicted in FIG. 2. As depicted in FIG. 6, a resistivity tool 600 may be included in the drill pipe connected to the MWD collar 205 between the MWD collar 205 and the surface. The resistivity tool 600 may include a transmitter and battery module 602, a processing device, a memory device, etc. In some embodiments, the transmitter and battery module 602 may be installed and/or integrated directly as components of the resistivity tool 600. The resistivity tool 600 may be built into a collar, which resides above the MWD collar 205. The directional sensors (e.g., magnetometers), in some embodiments, may be located near the top of the MWD tool 109 such that it is located farther from a mud motor (which may produce vibrations when operating that may affect signal quality). The distance between the magnetic transmission antenna of the transmitter and battery module 602 and the magnetometers of the MWD tool 109 may be reduced such that the magnetic field and/or transmitted by the magnetic transmission antenna does not have to travel far. As a result, one or more characteristics of the data (e.g., signal to noise ratio, errors, etc.) in the magnetic field and/or signal may be improved.

Figure 7:
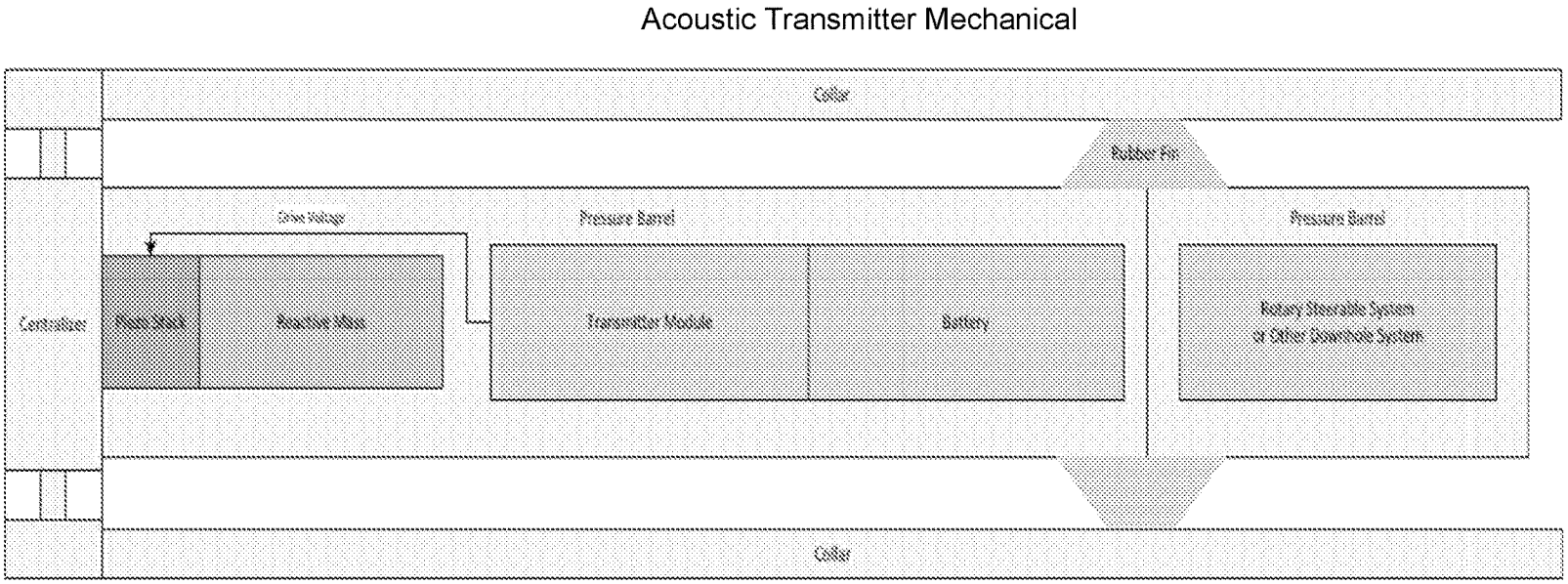
FIG. 7 is a block diagram of various components included in a transmitter assembly of an acoustic system of an intra-BHA, according to embodiments of the disclosure.

FIG. 7 is a block diagram of various components included in a transmitter assembly of an acoustic system of an intra-BHA, according to embodiments of the disclosure. The transmitter assembly may include various components, such as a battery, a transmitter module, a piezoelectric stack, and/or a reactive mass. A rotary steerable system (RSS) and/or other downhole system may be communicatively coupled, operatively coupled, and/or electrically coupled to the transmitter assembly such that the RSS and/or other downhole system may transmit and/or receive data or information via the transmitter module. The RSS and/or other downhole system may include a communication interface and/or protocol that enables short range wireless and/or wired communication (e.g., akin to Bluetooth and similar data transmission range, or near field communication, etc.).

The transmitter module may transmit a drive voltage to the piezoelectric stack. The drive voltage is a sine wave at a certain frequency and it drives the piezoelectric stack to expand and contract against the reactive mass based off the voltage that's applied and the reactive mass moves back and forth to "bang" or vibrate against the centralizer. The centralizer is connected to the drill collar. The rubber fin may be inserted between the collar and a pressure barrel that encapsulates the transmitter assembly and the RSS or other downhole system. The mechanical vibrations pass through the centralizer to the collar to cause the collar to vibrate to transmit the data as desired.

In some embodiments, when an electromagnetic system is used in the intra-BHA, a piezoelectric stack may or may not be included, and an electric coil may be included. The electric coil may discharge an electromagnetic field in a data pattern representing the information or data received from the RSS or other downhole system. The electromagnetic field may be received by one or more magnetometers and/or solenoids of the MWD tool 109 and/or separate receiver included in the MWD collar.

Figure 8:
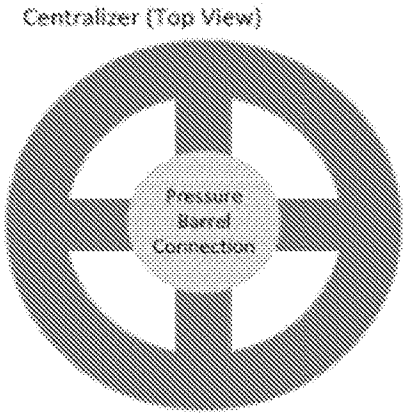
FIG. 8 is a top view diagram of the centralizer.

FIG. 8 is a top view diagram of the centralizer. The centralizer may include various prongs that connect the pressure barrel to the collar. The centralizer acts as a mechanical interface to send the mechanical vibrations from the centralizer (vibrations produced by piezoelectric stack and reactive mass) to the collar. The centralizer may be used for centralization and alignment. It also provides mechanical support.

Figure 9:
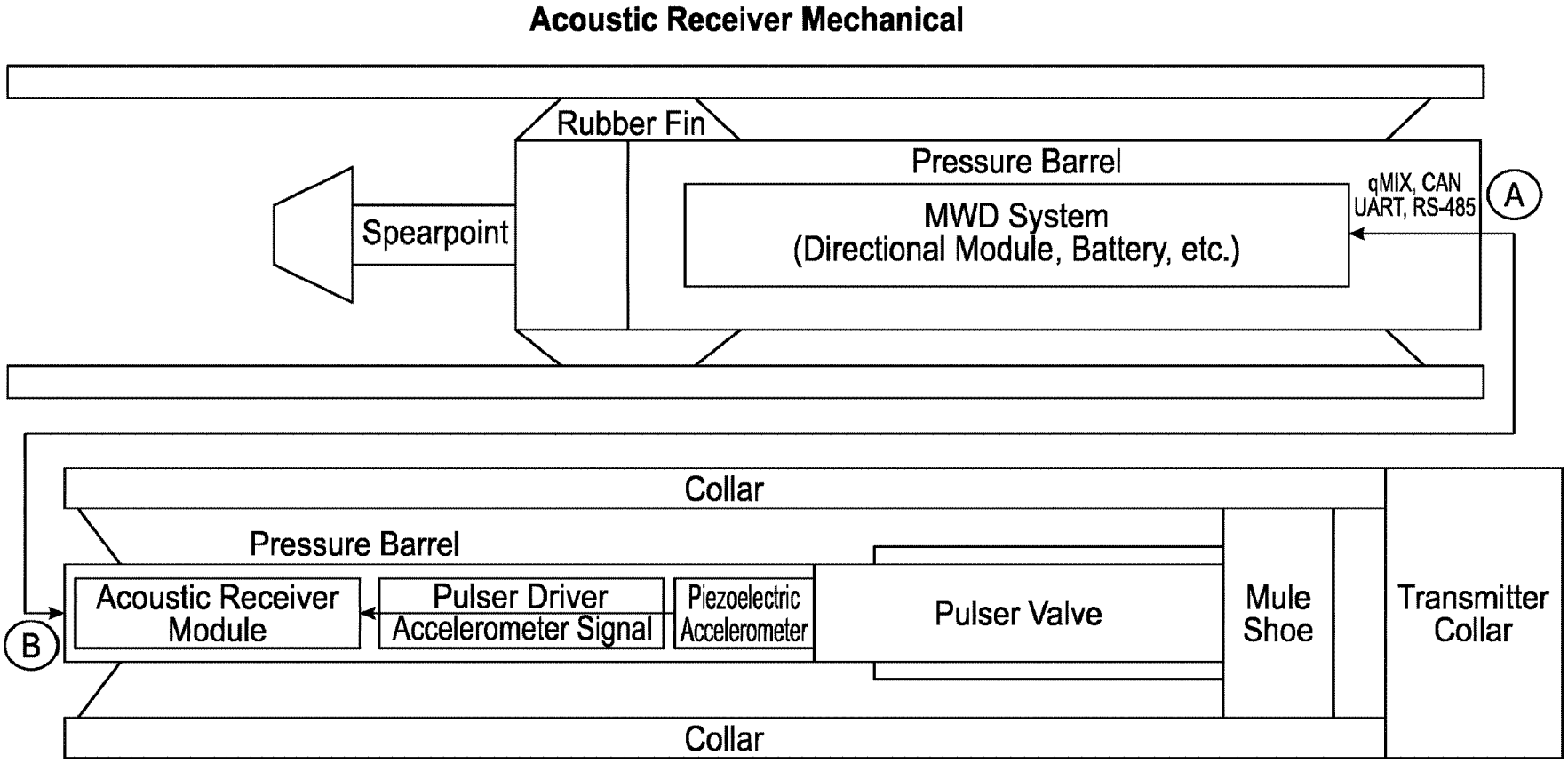
FIG. 9 is a block diagram of MWD tool (or system) connected to an intra-BHA including a receiver assembly and a transmitter assembly (disposed in the transmitter collar).

FIG. 9 is a block diagram of MWD tool (or system) connected to an intra-BHA including a receiver assembly and a transmitter assembly (disposed in the transmitter collar). The block diagram should be read top to bottom, left to right, where the circle A leads to circle B. As depicted, the MWD tool is connected to a spearpoint that is used to raise and/or lower the retrievable MWD tool out of or into the pipe collar. The MWD tool may include a directional module, a receiver (e.g., magnetometers), a battery, and other components. The MWD tool may be communicatively coupled to the receiver module of the receiver assembly via a communication interface (e.g., qMIX, CAN, UART, RS-485). Two-way communication may be enabled between the receiver module and the MWD tool.

The receiver assembly may include the receiver module and a piezoelectric accelerometer. The piezoelectric accelerometer may receive the acoustic sound signal or vibrations on the collar that were emitted by the centralizer from the piezoelectric stack and the vibrating mass. In some embodiments, when the signal including the data is transmitted via an electromagnetic force, an electromagnetic sensing element may be used, such as a magnetometer, solenoid, or the like. The accelerometer may transmit a signal, based on the received acoustic sound wave or vibration, through the pulser driver circuitry to the receiver module. The receiver module may transmit the signal to the MWD tool via the communication interface. The MWD tool may transmit a pressure signal representing the data from the RSS or other downhole system to the surface processor.

Figure 10:
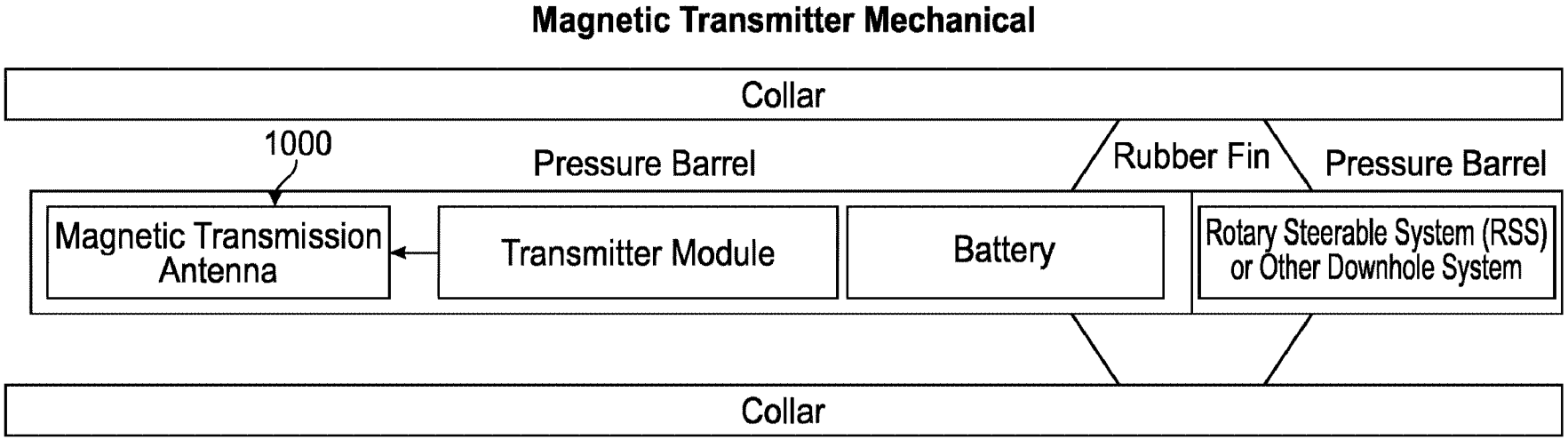
FIG. 10 is a block diagram of various components included in a transmitter assembly of a magnetic system of an intra-BHA, according to embodiments of the disclosure.

FIG. 10 is a block diagram of various components included in a transmitter assembly of a magnetic transmitter of an intra-BHA, according to embodiments of the disclosure. The transmitter assembly may include various components, such as a magnetic transmission antenna, a battery, and a transmitter module. A rotary steerable system (RSS) and/or other downhole system may be communicatively coupled, operatively coupled, and/or electrically coupled to the transmitter assembly such that the RSS and/or other downhole system may transmit and/or receive data or information via the transmitter module. The RSS and/or other downhole system may include a communication interface and/or protocol that enables short range wireless and/or wired communication (e.g., akin to Bluetooth and similar data transmission range, or near field communication, etc.).

The transmitter module may transmit a drive voltage to the magnetic transmission antenna 1000. The magnetic transmission antenna 1000 may include one or more coil windings (e.g., electrical solenoids, electric transformers and/or inductors) wrapped around one or more ferrous cores. For example, in some embodiments, the ferrous cores may be a drill collar, drill pipe, and/or a ferrous cylinder that the windings are wrapped around. In some embodiments, one or more coil windings may be wrapped around a single solid ferrous core. The drive voltage may be applied to the coil windings wrapped around the ferrous core and may cause a magnetic field and/or signal to be generated at a certain frequency (e.g., low frequency less than 1 kilohertz) that encodes data received from the downhole system. Certain encoding and signaling techniques may be employed, as described further herein. The coil windings may discharge a magnetic field in a data pattern representing the information or data received from the RSS or other downhole system. The magnetic field may be received by one or more magnetometers and/or solenoids of the MWD tool 109 and/or separate receiver included in the MWD collar.

Figure 11:
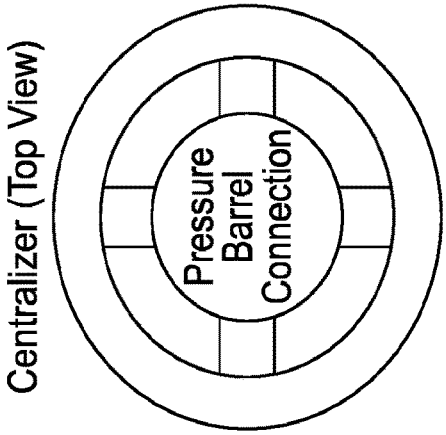
FIG. 11 is a top view diagram of the centralizer, according to embodiments of the disclosure.

FIG. 11 is a top view diagram of a centralizer. The centralizer may include various prongs that connect the pressure barrel to the collar. The centralizer acts as a mechanical interface to send the mechanical vibrations from the centralizer (vibrations produced by piezoelectric stack and reactive mass) to the collar. In some embodiments, when the magnetic transmission antenna 1000 is used, the centralizer may not be used (as depicted in FIG. 10). The centralizer may be used for centralization and alignment. It also provides mechanical support.

Figure 12:
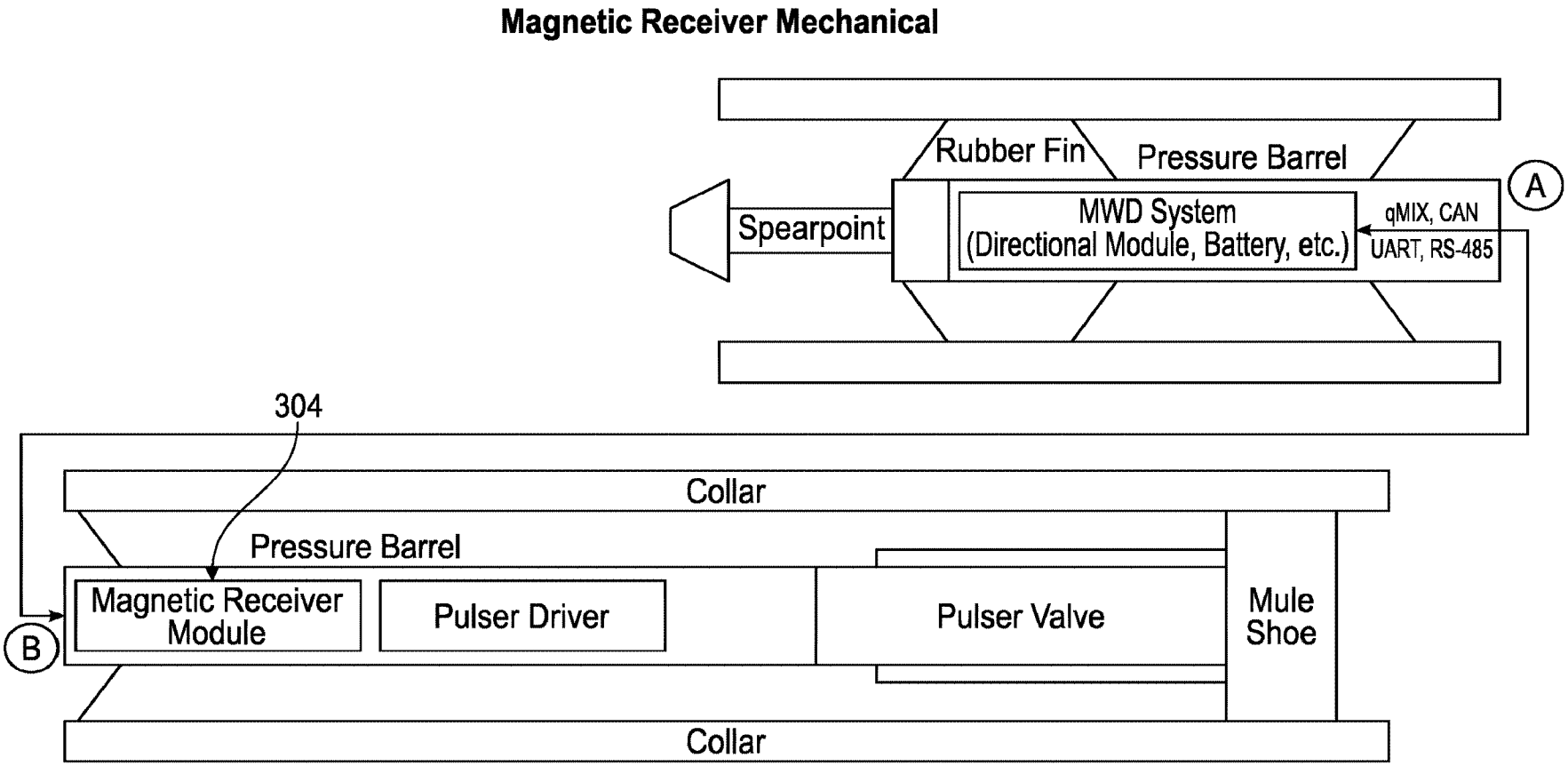
FIG. 12 is a block diagram of various components included in a receiver assembly of a magnetic system of an intra-BHA, according to embodiments of the disclosure.

FIG. 12 is a block diagram of various components included in a receiver assembly of a magnetic system of an intra-BHA, according to embodiments of the disclosure. The block diagram should be read top to bottom, left to right, where the circle A leads to circle B. As depicted, the MWD tool is connected to a spearpoint that is used to raise and/or lower the retrievable MWD tool out of or into the pipe collar. The MWD tool may include a directional module, a receiver (e.g., magnetometers), a battery, and other components. The MWD tool may be communicatively coupled to a receiver module 304 of the receiver assembly via a communication interface (e.g., qMIX, CAN, UART, RS-485). Two-way communication may be enabled between the receiver module and the MWD tool.

The receiver assembly may include the receiver module. The receiver module 304 may include one or more magnetometers and/or solenoids that are configured to receive the magnetic field and/or signal that were emitted by the magnetic transmission antenna 1000. The receiver module 304 may transmit the signal to the MWD tool via the communication interface. The MWD tool may transmit a pressure signal and/or other signal representing the data from the RSS or other downhole system (e.g., mud motor) to the surface processor.

Figure 13:
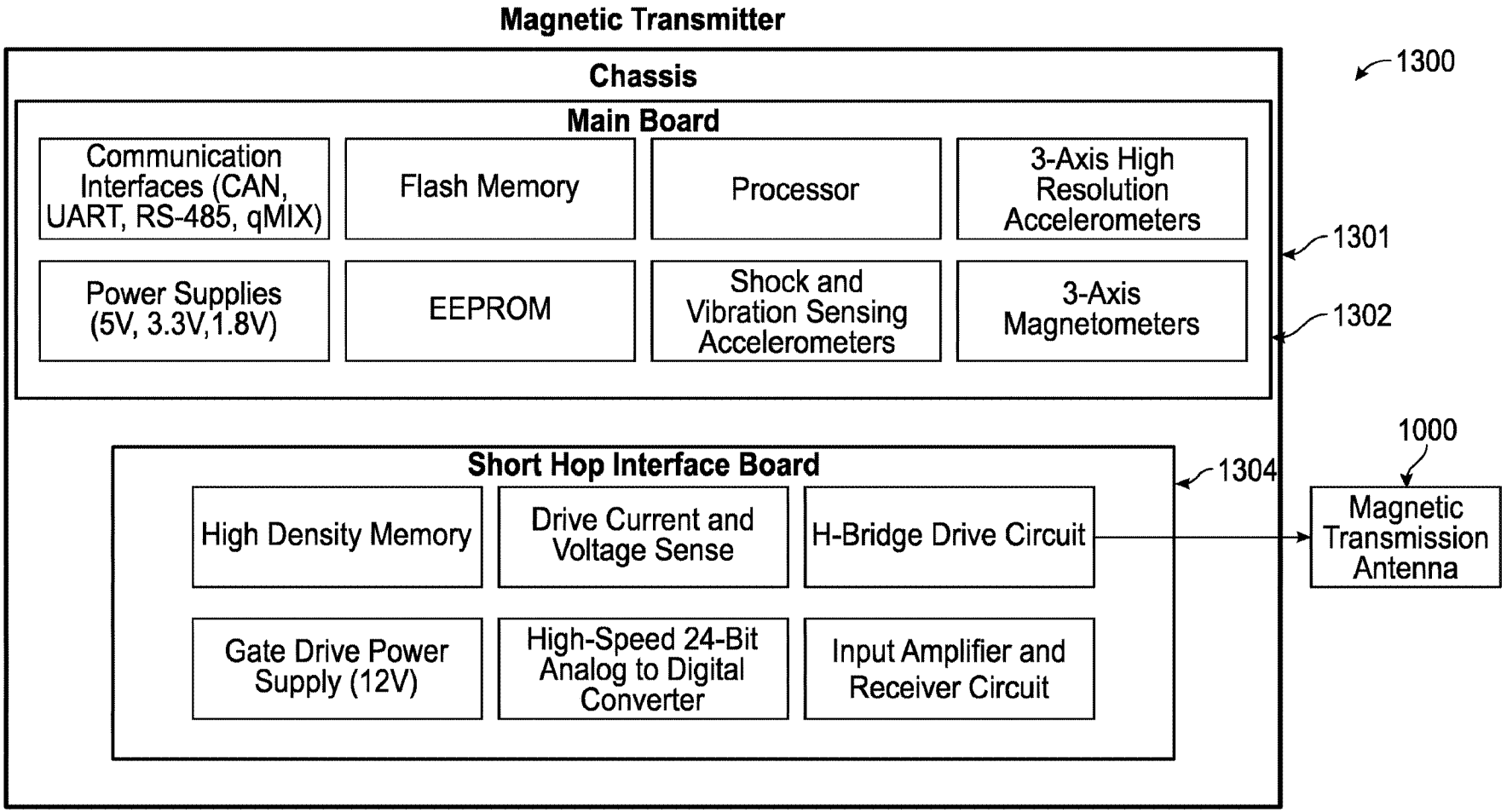
FIG. 13 is a block diagram of components of a transmitter module in a magnetic system, according to embodiments of the disclosure.
Figure 14:
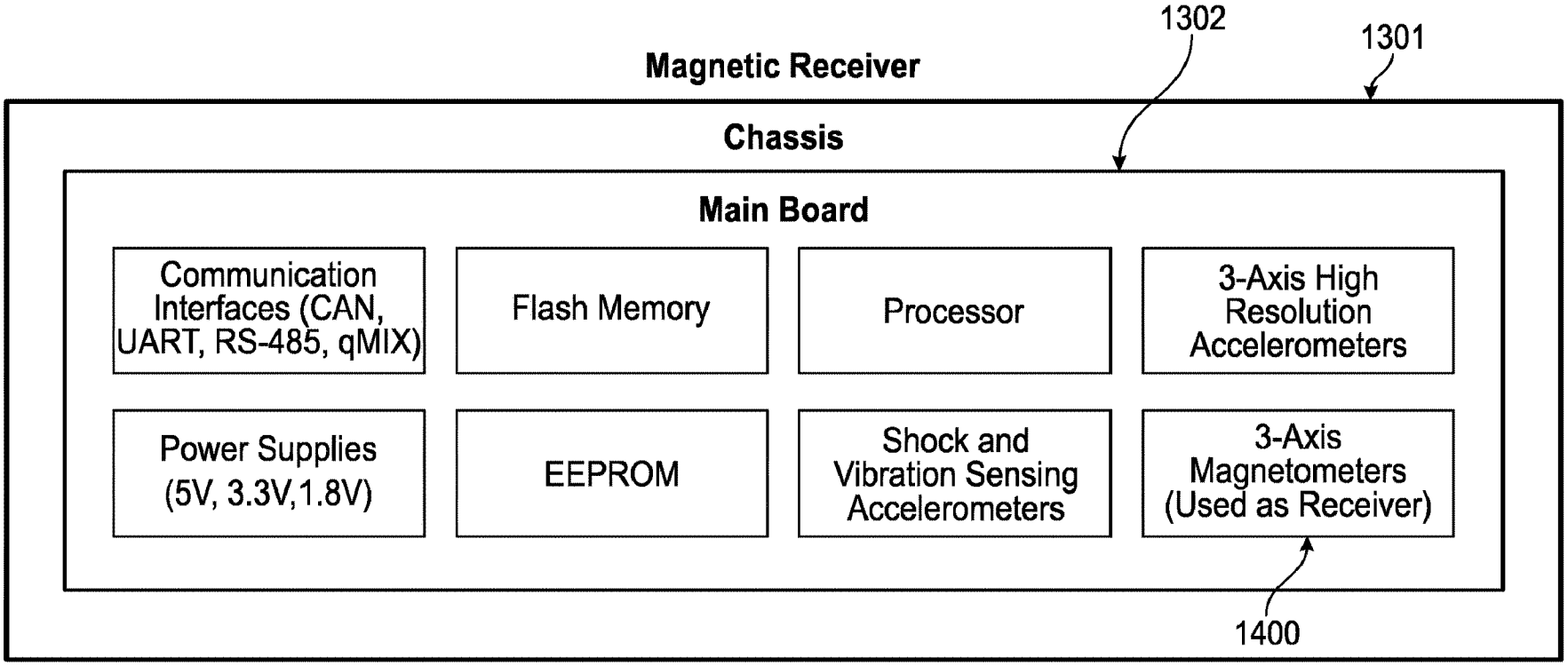
FIG. 14 is a block diagram of components of a receiver module in a magnetic system, according to embodiments of the disclosure.

FIG. 13 is a block diagram of components of a magnetic transmitter module 1300 of a magnetic system. FIG. 14 is a block diagram of components of a magnetic receiver module of a magnetic system. Focusing on FIG. 13 representing the magnetic transmitter 1300, a chassis 1301 may include a main board 1302 and a short hop interface board 1304. The main board 1302 may include communication interfaces (CAN, UART, RS-485, qMIX), flash memory, a processor, a 3-axis high resolution accelerometers, power supplies, EEPROM, shock and vibration sensing accelerometers, and/or 3-axis magnetometers. The short hop interface board 1304 may include high density memory, drive current and voltage sensor, H-bridge drive circuit (used to drive the magnetic transmission antenna 1000), a gate drive power supply, high-speed 24-bit analog to digital converter, and input amplifier and receiver circuit. The H-bridge drive circuit provides a drive voltage to drive the magnetic transmission antenna 1000 to cause the coil windings wrapped around the ferrous core to emit a magnetic field and/or signal.

FIG. 14 highlights the 3-axis magnetometers 1400 that may be used as the receiver of the magnetic field and/or signal emitted by the magnetic transmission antenna 1000. As depicted, the main board 1302 included on the chassis 1301 may include the 3-axis magnetometers 1400. In some embodiment, the magnetometers 1400 may be included on the main board 1302 to enable directional sensing and detecting by the MWD tool 109. Accordingly, using the magnetometers to also receive the magnetic field and/or signal reduces cost and/or computing resources because, in some embodiments, no additional receiver hardware is used. Further, the use of the magnetic transmission antenna 1000 and the receiver module 304 (e.g., magnetometers) may not use a gap sub to transmit an electrical signal, as may be used with an electromagnetic transmitter and receiver combination.

In some embodiments, the MWD directional module of the MWD tool 109 may include the same components depicted in FIG. 14 and may be used as a magnetic receiver. However, in some embodiments, the signal strength may be stronger if the magnetic receiver is a separate unit closer to the transmitter.

Figure 15:
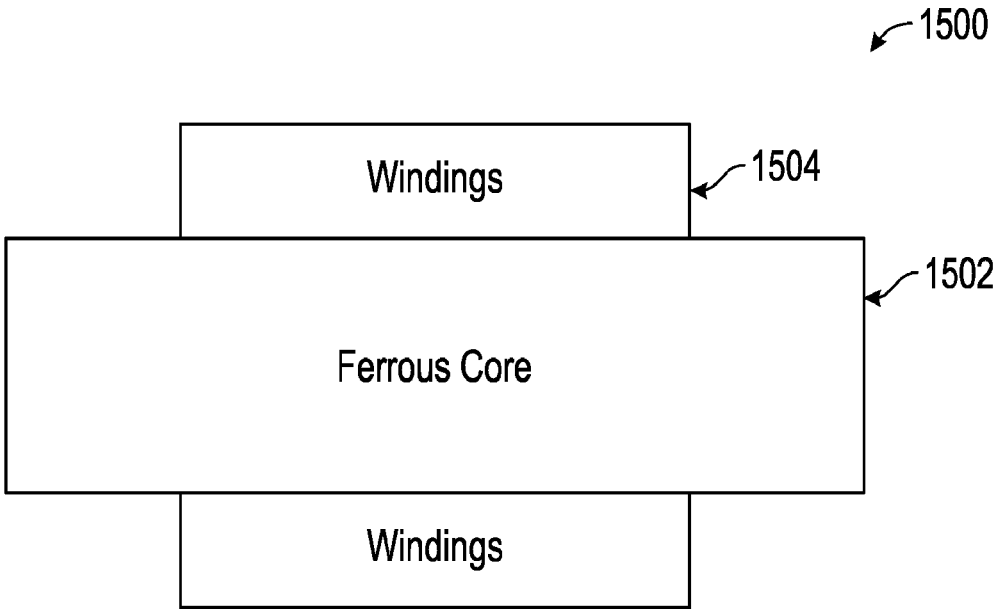
FIG. 15 is a block diagram of an example magnetic transmission antenna, according to embodiments of the disclosure.

FIG. 15 is a block diagram of an example magnetic transmission antenna 1500, according to embodiments of the disclosure. As depicted, a single ferrous core 1502 may be used with one or more coil windings 1504. The H-bridge drive circuit of the short hop interface board 1304 may energize the coil windings 1504 to cause a magnetic field and/or signal to be emitted.

Figure 16:
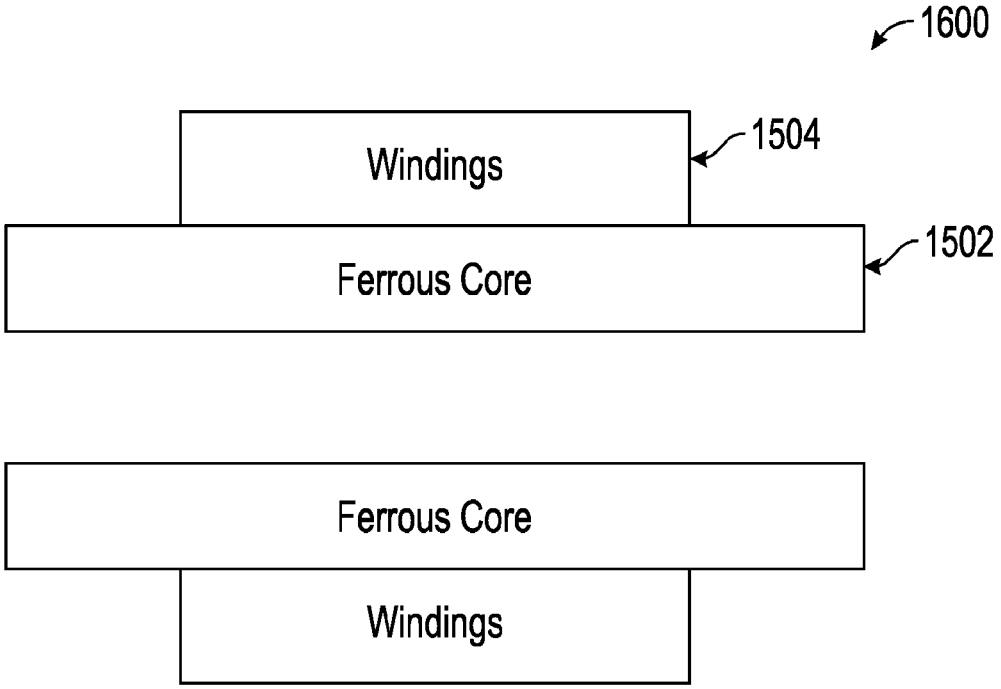
FIG. 16 is a block diagram of an example magnetic transmission antenna, according to embodiments of the disclosure.

FIG. 16 is a block diagram of an example magnetic transmission antenna 1600, according to embodiments of the disclosure. As depicted, dual ferrous cores 1502 may be used with one or more coil windings 1504. The dual ferrous cores 1502 may be a drill collar, drill pipe, or a ferrous cylinder that the coil windings are wrapped around. The H-bridge drive circuit of the short hop interface board 1304 may energize the coil windings 1504 to cause a magnetic field and/or signal to be emitted.

Figure 17:
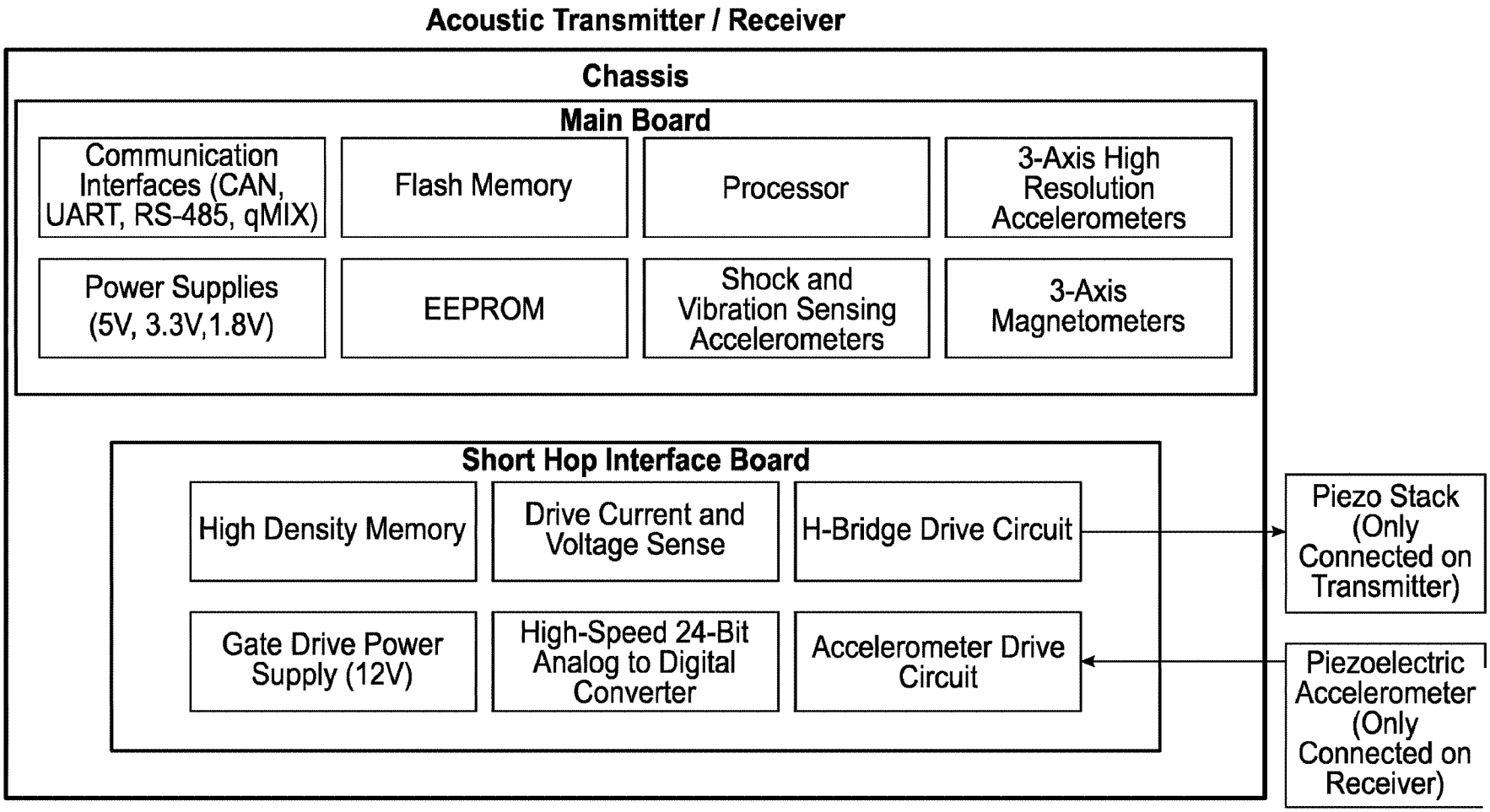
FIG. 17 is a block diagram of components of a receiver and/or transmitter in an acoustic system of an intra-BHA, according to embodiments of the disclosure.
Figure 18:
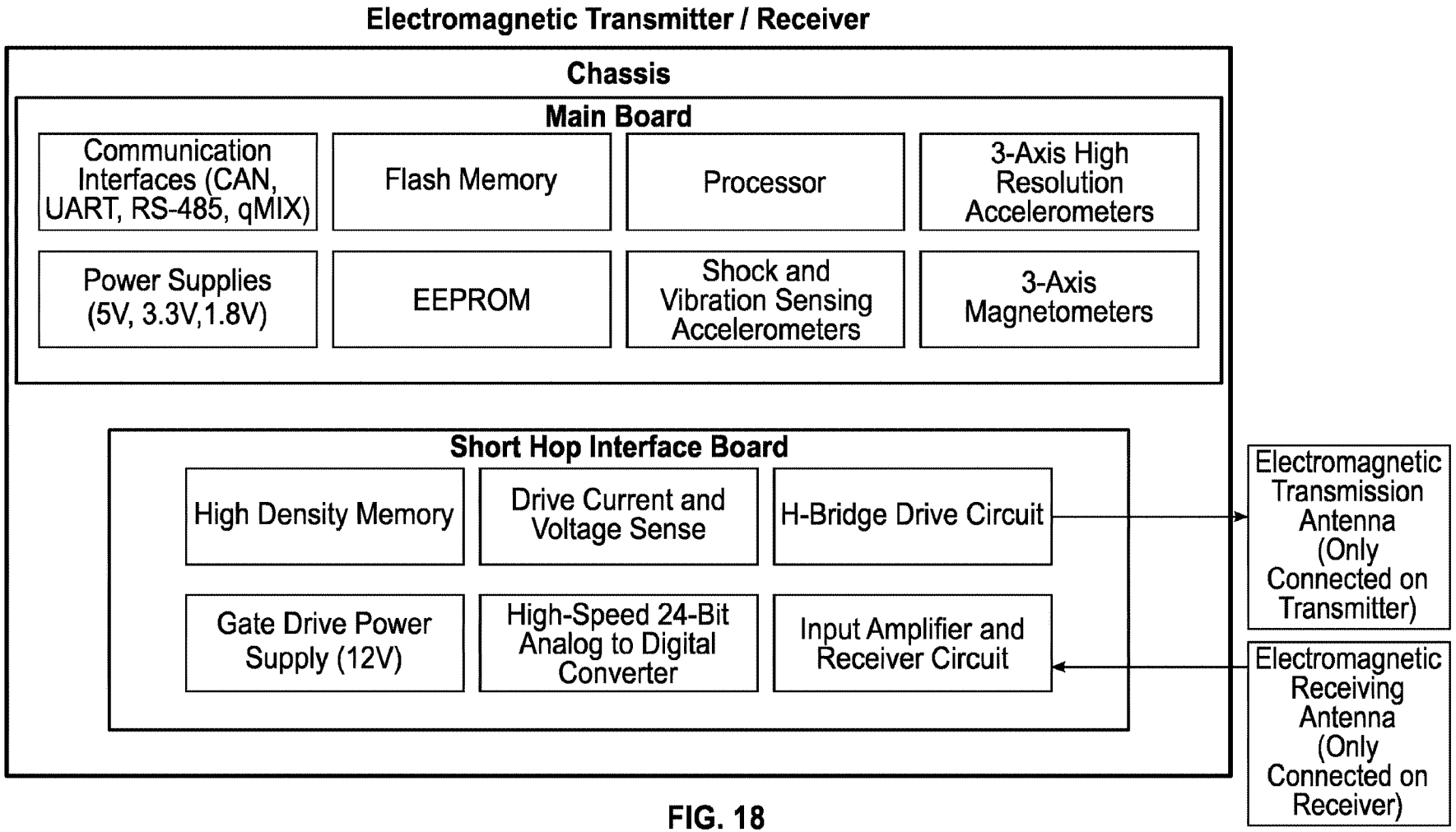
FIG. 18 is a block diagram of components of a receiver and/or transmitter in an electromagnetic system of an intra-BHA, according to embodiments of the disclosure.

FIG. 17 is a block diagram of components of a receiver module and/or transmitter module in an acoustic system of an intra-BHA. FIG. 18 is a block diagram of components of a receiver and/or transmitter in an electromagnetic system of an intra-BHA. The receiver and transmitter in both systems may include similar components except that the piezoelectric stack and piezoelectric accelerometer may be used in the acoustic system, whereas an electromagnetic transmission antenna (e.g., coil, electrode) and an electromagnetic receiving antenna (e.g., magnetometer, solenoid, electrode, etc.) may be used in the electromagnetic system. Further, in the electromagnetic system, electrical contact may be utilized to carry a current or voltage across a structure (e.g., a gap sub, a collar etc.). As previously described, the use of the magnetic transmission antenna 1000 and the magnetometers 1400 may enable the transmission of a magnetic field and/or signal without the use of a gap sub or other structure.

Focusing on FIG. 17 representing the acoustic system, a chassis may include a main board and a short hop interface board, similar to FIG. 13. The main board may include communication interfaces (CAN, UART, RS-485, qMIX), flash memory, a processor, a 3-axis high resolution accelerometers, power supplies, EEPROM, shock and vibration sensing accelerometers, and/or 3-axis magnetometers. The short hop interface board may include high density memory, drive current and voltage sensor, H-bridge drive circuit, a gate drive power supply, high-speed 24-bit analog to digital converter, and an accelerometer drive circuit. The piezoelectric stack may just be used on the transmitter assembly and may connected to the H-bridge drive circuit, such that the H-bridge drive circuit provides a drive voltage to drive the piezoelectric stack to cause a reactive mass to move and cause vibrations. The piezoelectric accelerometer may just be used on the receiver and may be connected to the accelerometer drive circuit.

Focusing on FIG. 18 representing the electromagnetic system, a chassis may include the main board with the same components as the acoustic system. The short hop interface board includes the same components as the acoustic system except in FIG. 17 an input amplifier and receiver circuit is used to connect to the electromagnetic receiving antenna. As depicted, the electromagnetic transmission antenna is connected and driven by the H-bridge drive circuit to emit a signal, discharge an electromagnetic field, etc. The electromagnetic transmission antenna may include one or more electrodes that are in electrical contact with a surface that may connect to the electromagnetic receiving antenna.

Figure 19:
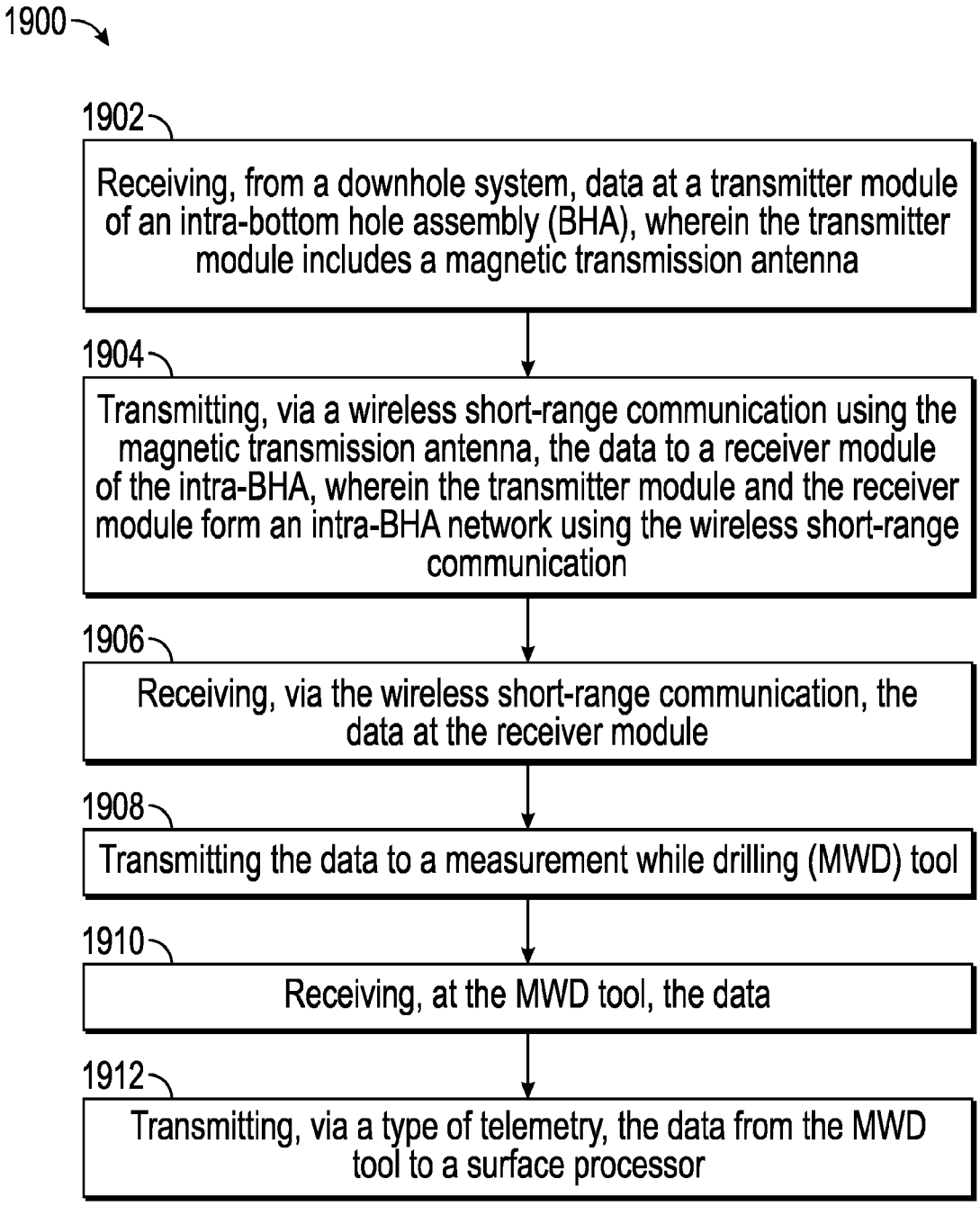
FIG. 19 is an example method for using an intra-BHA network to transmit data from a downhole system using a short range wireless communication to a MWD tool that transmit the data to a surface processor using a type of telemetry, according to embodiments of the disclosure.

FIG. 19 is an example method 1900 for using an intra-BHA network to transmit data from a downhole system using a short range wireless communication to a MWD tool that transmits the data to a surface processor using a type of telemetry (e.g., longer range communication than the short range wireless communication used by the intra-BHA). In some embodiments, the type of telemetry may include mud pulse or electromagnetic. One or more operations of the method may be performed by one or more components described herein (e.g., the intra-BHA 201, the MWD tool 109, the surface processor, a downhole system).

At operation 1902, data may be received from a downhole system via a short range communication at a transmitter module of an intra-BHA. The transmitter module may include one or more transmission mechanisms, such as one or more magnetic transmission antennas, acoustic transmitters (piezo stack, reactive mass), and/or electromagnetic transmitters (electromagnetic transmission antennas). The downhole system may be a rotary steerable system (RSS), a drill bit, a smart mud motor, a near-bit system, or the like. The data may relate to any suitable directional drilling measurement data and/or geological measurement data obtained from the downhole system, such as drilling direction, vibration measurement, angle of azimuth, angle of inclination, angle of toolface, gamma ray emissions, etc. At operation 1904, the data may be transmitted, via a wireless short-range communication using a transmission mechanism (e.g., magnetic transmission antenna, acoustic transmitter, electromagnetic transmitter, etc.), by the transmitter module to a receiver module of the intra-BHA. In some embodiments, it may be desirable to use the magnetic transmission antenna, such as during drilling operations when there are vibrations because the signal transmitted by the magnetic transmission antenna may be unaffected by the vibrations. For example, the acoustic transmitter may be affected by vibrations of one or more components of the tool drill string, and thus it may be desirable to use the magnetic transmission antenna. In some embodiments, using the magnetic transmission antenna a magnetic receiver may be referred herein as a magnetic transmission mode, using the acoustic transmitter and acoustic receiver may be referred herein as an acoustic transmission mode, and using the electromagnetic transmitter and electromagnetic receiver may be referred herein as an electromagnetic transmission mode. Accordingly, the present disclosure may include three different transmission modes that may be toggled between or used in conjunction with each other based on one or more operating conditions, time periods, measurements, geological characteristics, directional data, tool settings, etc. For example, any one or more of the transmission modes (e.g. magnetic transmission mode, acoustic transmission mode, electromagnetic transmission mode) may be selected based on the one or more operating conditions, time periods, measurements, geological characteristics, directional data, tool settings, etc.

The transmitter module and the receiver module may form an intra-BHA network using the wireless short-range communication. At operation 1906, the data may be received, via the wireless short-range communication, at the receiver module of the intra-BHA network. At 1908, the data may be transmitted to a MWD tool. At 1910, the data may be received at the MWD tool. At 1912, the data may be transmitted, via a type of telemetry, from the MWD tool 109 to a surface processor 118.

In some embodiments, the receiver module may include one or more magnetometers. The one or more magnetometers may be separate from a control board of an MWD tool or may be included on the control board of the MWD tool. The magnetic transmission antenna may include one or more ferrous cores and one or more coil windings. In some embodiments, the magnetic transmission antenna may be configured to transmit the data at a frequency below 1 kilohertz. In some embodiments, the transmitter module may include more than one transmission mechanism, such as smart control of which transmission mechanism is used may be employed based on one or more operating conditions (e.g., state of drill bit, detected vibrations, depth of tool drill string, direction of drilling, geological data, directional-drilling data, etc.).

For example, in some embodiments, the method 1900 may include determining whether the downhole system is currently performing a drilling operation (e.g., drilling, rotating, spinning, steering, etc.). Based on the downhole system currently performing the drilling operation, the method 1900 may include using the magnetic transmission antenna to transmit the data. In some embodiments, based on the downhole system not currently performing the drilling operation, the method 1900 may include transmitting the data using an acoustic transmitter. In some embodiments, the data may be transmitted by the acoustic transmitter at a frequency range between 1 kilohertz and 5 kilohertz.

In some embodiments, the data may be transmitted using one or more techniques including binary keying, pulse position modulation, quadrature phase shift keying, or some combination thereof. Amplitude shift keying (ASK) may be used and is a form of amplitude modulation that represents digital data as variations in the amplitude (e.g., high and low amplitudes) of a carrier wave. ASK may also refer to binary on/off keying. A symbol representing one or more bits may be transmitted as a fixed-amplitude carrier wave at a fixed frequency for a specific time duration. In some embodiments, phase-shift keying may be used and the amplitude and frequency may remain constant and the bit stream may be represented by shifts in the phase of the modulated signal. In some embodiments, quadrature phase-shift keying (QPSK) may be used and may refer to a form of phase-shift keying where two bits are modulated at once, selecting one of four possible carrier phase shifts (0, 90, 180, or 270 degrees). Such a technique may enable a transmitted signal to carry twice as much information as PSK using the same bandwidth. In some embodiments, pulse position modulation (PPM) may be used and may refer to an analog modulating scheme in which the amplitude and width of the pulses are kept constant, while the position of each pulse, with reference to the position of a reference pulse varies according to the instantaneous sampled value of the message signal. Synchronization pulses may be transmitted by the transmitter module to maintain synchronization between the receiver module and the transmitter module. Further, one or more combinations of the techniques described herein may be used to transmit data via a signal from the transmitter module (e.g., magnetic transmission antenna, acoustic transmitter, electromagnetic transmitter, etc.).

Figure 20:
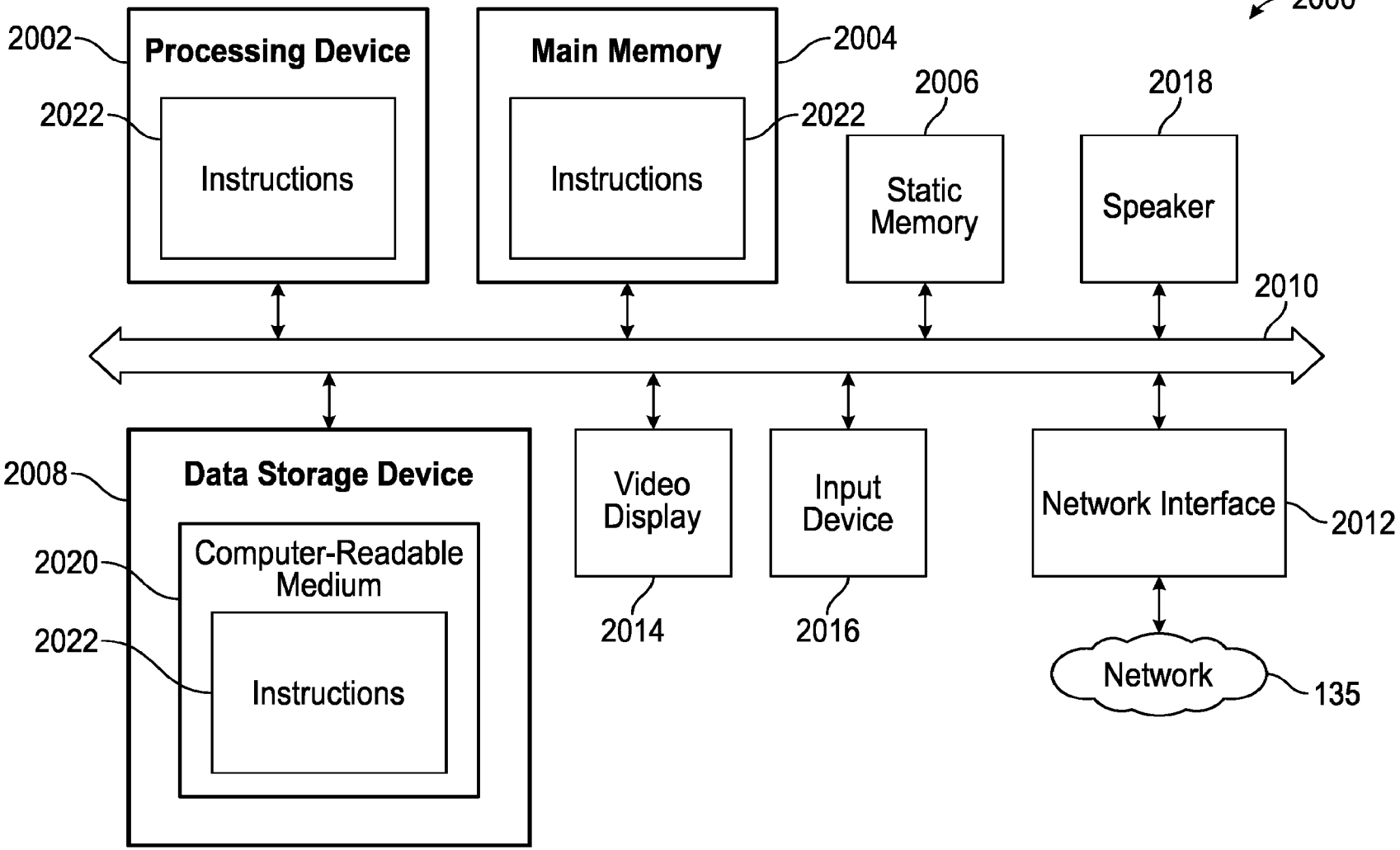
FIG. 20 illustrates an example computer system according to the present disclosure.

FIG. 20 shows an example computer system 2000 which can perform any one or more of the methods, steps, or operations described herein, in accordance with one or more aspects of the present disclosure. In one example, computer system 2000 may correspond to the surface processor, the MWD tool, the intra-BHA assembly, the downhole system, or any suitable component of FIGS. 1-18.

The computer system 2000 includes a processing device 2002, a main memory 2004 (e.g., read-only memory (ROM), flash memory, solid state drives (SSDs), dynamic random access memory (DRAM) such as synchronous DRAM (SDRAM)), a static memory 2006 (e.g., flash memory, solid state drives (SSDs), static random access memory (SRAM)), and a data storage device 2008, which communicate with each other via a bus 2010.

Processing device 2002 represents one or more general-purpose processing devices such as a microprocessor, central processing unit, or the like. More particularly, the processing device 2002 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processing device 2002 may also be one or more special-purpose processing devices such as an application specific integrated circuit (ASIC), a system on a chip, a field programmable gate array (FPGA), a digital signal processor (DSP), network processor, or the like. The processing device 2002 is configured to execute instructions for performing any of the operations and steps discussed herein.

The computer system 2000 may further include a network interface device 2012. The computer system 2000 also may include a video display 2014 (e.g., a liquid crystal display (LCD), a light-emitting diode (LED), an organic light-emitting diode (OLED), a quantum LED, a cathode ray tube (CRT), a shadow mask CRT, an aperture grille CRT, a monochrome CRT), one or more input devices 2016 (e.g., a keyboard and/or a mouse), and one or more speakers 2018 (e.g., a speaker). In one illustrative example, the video display 2014 and the input device(s) 2016 may be combined into a single component or device (e.g., an LCD touch screen).

The data storage device 2016 may include a computer-readable medium 2020 on which the instructions 2022 embodying any one or more of the methods, operations, or functions described herein is stored. The instructions 2022 may also reside, completely or at least partially, within the main memory 2004 and/or within the processing device 2002 during execution thereof by the computer system 2000. As such, the main memory 2004 and the processing device 2002 also constitute computer-readable media. The instructions 2022 may further be transmitted or received over a network 135 via the network interface device 2012.

While the computer-readable storage medium 2020 is shown in the illustrative examples to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to, solid-state memories, optical media, and magnetic media.

Consistent with the above disclosure, the examples of systems and method enumerated in the following clauses are specifically contemplated and are intended as a non-limiting set of examples.

CLAUSES

1. A method comprising:

receiving, from a downhole system, data at a transmitter module of an intra-bottom hole assembly (BHA), wherein the transmitter module comprises a magnetic transmission antenna;

transmitting, via a wireless short-range communication using the magnetic transmission antenna, the data to a receiver module of the intra-BHA, wherein the transmitter module and the receiver module form an intra-BHA network using the wireless short-range communication;

receiving, via the wireless short-range communication, the data at the receiver module;

transmitting the data to a measurement while drilling (MWD) tool;

receiving, at the MWD tool, the data; and transmitting, via a type of telemetry, the data from the MWD tool to a surface processor.

2. The method of any preceding clause, wherein the receiver module comprises one or more magnetometers.

3. The method of any preceding clause, wherein the magnetic transmission antenna comprises a ferrous core and one or more coil windings.

4. The method of any preceding clause, wherein the magnetic transmission antenna is configured to transmit the data at a frequency below 1 kilohertz.

5. The method of any preceding clause, further comprising:

determining whether the downhole system is currently performing a drilling operation; and based on the downhole system currently performing the drilling operation, using the magnetic transmission antenna to transmit the data.

6. The method of any preceding clause, further comprising:

determining whether the downhole system is performing a drilling operation; and based on the downhole system not currently performing the drilling operation, transmitting the data using an acoustic transmitter.

7. The method of any preceding clause, wherein the data is transmitted by the acoustic transmitter at a frequency range between 1 kilohertz and 5 kilohertz.

8. The method of any preceding clause, wherein the data is transmitted using one or more techniques comprising binary keying, pulse position modulation, quadrature phase shift keying, or some combination thereof.

9. A system comprising:

a downhole system;

a transmitter module of an intra-bottom hole assembly, wherein the transmitter module comprises a magnetic transmission antenna;

a receiver module of the intra-BHA; and wherein:

the transmitter is configured to receive, from the downhole system, data, and to transmit, via a wireless short-range communication using the magnetic transmission antenna, the data to the receiver module of the intra-BHA, wherein the transmitter module and the receiver module form an intra-BHA network using the wireless short-range communication, and the receiver module is configured to receive, via the wireless short-range communication, the data, and transmit the data to a measurement while drilling (MWD) tool configured to receive the data and to transmit, via a type of telemetry, the data to a surface processor.

10. The system of any preceding clause, wherein the receiver module comprises one or more magnetometers.

11. The system of any preceding clause, wherein the magnetic transmission antenna comprises a ferrous core and one or more coil windings.

12. The system of any preceding clause, wherein the magnetic transmission antenna is configured to transmit the data at a frequency below 1 kilohertz.

13. The system of any preceding clause, wherein a processing device is configured to:

determine whether the downhole system is currently performing a drilling operation; and based on the downhole system currently performing the drilling operation, use the magnetic transmission antenna to transmit the data.

14. The system of any preceding clause, wherein a processing device is configured to:

determine whether the downhole system is performing a drilling operation; and based on the downhole system not currently performing the drilling operation, transmit the data using an acoustic transmitter.

15. The system of any preceding clause, wherein the data is transmitted by the acoustic transmitter at a frequency range between 1 kilohertz and 5 kilohertz.

16. The system of any preceding clause, wherein the data is transmitted using one or more techniques comprising binary keying, pulse position modulation, quadrature phase shift keying, or some combination thereof.

17. An intra-bottom hole assembly (BHA) comprising:

a transmitter module, wherein the transmitter module comprises a magnetic transmission antenna, and is configured to receive, from a downhole system, data, and to transmit, via a wireless short-range communication using the magnetic transmission antenna, the data to a receiver module of the intra-BHA, wherein the transmitter module and the receiver module form an intra-BHA network using the wireless short-range communication; and the receiver module is configured to receive, via the wireless short-range communication, the data, and transmit the data to a measurement while drilling (MWD) tool configured to receive the data and to transmit, via a type of telemetry, the data to a surface processor.

18. The intra-BHA of any preceding clause, wherein the receiver module comprises one or more magnetometers.

19. The intra-BHA of any preceding clause, wherein the magnetic transmission antenna comprises a ferrous core and one or more coil windings.

20. The intra-BHA of any preceding clause, wherein the data is transmitted using one or more techniques comprising binary keying, pulse position modulation, quadrature phase shift keying, or some combination thereof.

What is claimed is:

1. A method comprising:

using a first command received from a surface processor, controlling, via a measurement while drilling (MWD) tool using an intra-bottom hole assembly (BHA), a rotary steerable system of a downhole system by changing an operating parameter;

receiving, from the downhole system comprising the rotary steerable system, data at a transmitter module of the BHA, wherein the transmitter module comprises a transmitter coil that discharges or charges an electromagnetic field in a data pattern representing the data;

transmitting, via a wireless short-range communication using the transmitter coil, the data to a receiver module of the intra-BHA, wherein the transmitter module and the receiver module are both disposed in a pressure barrel within a drill collar, form an intra-BHA network using the wireless short-range communication, and the receiver module comprises a magnetometer;

receiving, via the wireless short-range communication, the data at the receiver module comprising the magnetometer;

transmitting the data to the MWD tool;

receiving, at the MWD tool, the data;

transmitting, via a type of telemetry, the data from the MWD tool to a surface processor; and responsive to the surface processor receiving the data, controlling, via the MWD tool, operation of the rotary steerable system based on a second command received from the surface processor, wherein the second command is generated based on the data received from the MWD tool.

2. The method of claim 1, wherein the receiver module comprises one or more magnetometers.

3. The method of claim 1, wherein the transmitter coil comprises one or more coil windings.

4. The method of claim 1, wherein the transmitter module is configured to transmit the data at a frequency below 1 kilohertz.

5. The method of claim 1, further comprising:

determining whether the downhole system is currently performing a drilling operation; and based on the downhole system currently performing the drilling operation, using the transmitter coil to transmit the data.

6. The method of claim 1, further comprising:

determining whether the downhole system is performing a drilling operation; and based on the downhole system not currently performing the drilling operation, transmitting the data using an acoustic transmitter.

7. The method of claim 6, wherein the data is transmitted by the acoustic transmitter at a frequency range between 1 kilohertz and 5 kilohertz.

8. The method of claim 1, wherein the data is transmitted using one or more techniques comprising binary keying, pulse position modulation, quadrature phase shift keying, or some combination thereof.

9. A system comprising:

a downhole system;

a transmitter module of an intra-bottom hole assembly, wherein the transmitter module comprises a transmitter coil;

a receiver module of the intra-BHA; and wherein:

using a first command received from a surface processor, a measurement while drilling (MWD) tool uses an intra-bottom hole assembly (BHA) to control a rotary steerable system of the downhole system by changing an operating parameter;

the transmitter is configured to receive, from the downhole system, data, and to transmit, via a wireless short-range communication using the transmitter coil, the data to the receiver module of the intra-BHA, wherein the transmitter module and the receiver module are both disposed in a pressure barrel within a drill collar, form an intra-BHA network using the wireless short-range communication, and the receiver module comprises a magnetometer, and the receiver module is configured to receive, via the wireless short-range communication, the data, and transmit the data to the MWD tool configured to receive the data and to transmit, via a type of telemetry, the data to a surface processor, and responsive to the surface processor receiving the data, controlling, via the MWD tool, operation of the rotary steerable system based on a second command received from the surface processor, wherein the second command is generated based on the data received from the MWD tool.

10. The system of claim 9, wherein the receiver module comprises one or more magnetometers.

11. The system of claim 9, wherein the transmitter coil comprises a ferrous core and one or more coil windings.

12. The system of claim 9, wherein the transmitter coil is configured to transmit the data at a frequency below 1 kilohertz.

13. The system of claim 9, wherein a processing device is configured to:

determine whether the downhole system is currently performing a drilling operation; and based on the downhole system currently performing the drilling operation, use the transmitter coil to transmit the data.

14. The system of claim 9, wherein a processing device is configured to:

determine whether the downhole system is performing a drilling operation; and based on the downhole system not currently performing the drilling operation, transmit the data using an acoustic transmitter.

15. The system of claim 14, wherein the data is transmitted by the acoustic transmitter at a frequency range between 1 kilohertz and 5 kilohertz.

16. The system of claim 1, wherein the data is transmitted using one or more techniques comprising binary keying, pulse position modulation, quadrature phase shift keying, or some combination thereof.

17. An intra-bottom hole assembly (BHA) comprising:

a transmitter module, wherein:

using a first command received from a surface processor, a measurement while drilling (MWD) tool uses an intra-bottom hole assembly (BHA) to control a rotary steerable system of a downhole system by changing an operating parameter, the transmitter module comprises a transmitter coil, and is configured to receive, from the downhole system, data, and to transmit, via a wireless short-range communication using the transmitter coil, the data to a receiver module of the intra-BHA, wherein the transmitter module and the receiver module are both disposed in a pressure barrel within a drill collar, form an intra-BHA network using the wireless short-range communication, and the receiver module comprises a magnetometer; and the receiver module is configured to receive, via the wireless short-range communication, the data, and transmit the data to a measurement while drilling (MWD) tool configured to receive the data and to transmit, via a type of telemetry, the data to a surface processor, and responsive to the surface processor receiving the data, controlling, via the MWD tool, operation of the rotary steerable system based on a second command received from the surface processor, wherein the second command is generated based on the data received from the MWD tool.

18. The intra-BHA of claim 17, wherein the receiver module comprises one or more magnetometers.

19. The intra-BHA of claim 17, wherein the transmitter coil comprises a ferrous core and one or more coil windings.

20. The intra-BHA of claim 17, wherein the data is transmitted using one or more techniques comprising binary keying, pulse position modulation, quadrature phase shift keying, or some combination thereof.

* * * * *